US010136712B2

(12) United States Patent
Taylor-Phillips

(10) Patent No.: US 10,136,712 B2
(45) Date of Patent: Nov. 27, 2018

(54) GARMENT HOLDER AND HAMPER TRAVELER

(71) Applicant: LaQuita Taylor-Phillips, Clinton, MD (US)

(72) Inventor: LaQuita Taylor-Phillips, Clinton, MD (US)

( * ) Notice: Subject to any disclaimer, the term of this patent is extended or adjusted under 35 U.S.C. 154(b) by 500 days.

(21) Appl. No.: 13/849,280

(22) Filed: Mar. 22, 2013

(65) Prior Publication Data

US 2013/0248310 A1 Sep. 26, 2013

Related U.S. Application Data

(60) Provisional application No. 61/614,493, filed on Mar. 22, 2012.

(51) Int. Cl.

| | |
|---|---|
| ***B65D 85/28*** | (2006.01) |
| ***A45C 5/00*** | (2006.01) |
| ***A45C 11/00*** | (2006.01) |
| ***A45C 13/02*** | (2006.01) |
| ***A45C 13/03*** | (2006.01) |
| *A45F 5/00* | (2006.01) |
| *A45C 7/00* | (2006.01) |

(52) U.S. Cl.

CPC ..... *A45C 5/005* (2013.01); *A45C 11/008* (2013.01); *A45C 13/02* (2013.01); *A45C 13/03* (2013.01); *A45C 7/0059* (2013.01); *A45C 2013/026* (2013.01); *A45F 5/00* (2013.01)

(58) Field of Classification Search

CPC .. A45C 3/004; A45C 3/02; A45C 3/00; A45C 13/02; A45C 5/00

USPC .... 190/100, 109, 111; 206/373, 37, 235, 38; D3/232, 303, 315, 905, 224; D32/53, D32/53.1, 54; 150/1, 52 R; 224/683, 224/681, 684, 253, 227

See application file for complete search history.

(56) References Cited

U.S. PATENT DOCUMENTS

| | | | |
|---|---|---|---|
| 1,625,668 | A | 4/1927 | London |
| 1,939,657 | A | 12/1933 | Brosseau et al. |
| 3,918,632 | A | 11/1975 | Neubauer |
| 4,378,866 | A | 4/1983 | Pelavin |
| 4,580,667 | A | 4/1986 | Herwood |

(Continued)

FOREIGN PATENT DOCUMENTS

| | | | |
|---|---|---|---|
| EP | 1712149 | A1 | 10/2006 |
| KR | 200307283000 | Y1 | 4/2003 |
| WO | 1996031402 | A1 | 10/1996 |

OTHER PUBLICATIONS

International Search Report and Written Opinion received for PCT Patent Application No. PCT/US2013/033570, dated Jul. 18, 2013, 9 pages.

*Primary Examiner* — Fenn C Mathew
*Assistant Examiner* — Cynthia Collado
(74) *Attorney, Agent, or Firm* — Jordan IP Law, LLC

(57) ABSTRACT

Solutions may provide for a traveler including a plurality of front two-in-one pockets, each of the front two-in-one pockets having a water repellent hamper pocket inside of a front pocket. The traveler may also include a plurality of hanging straps extending from a top portion of the traveler. In one example, the water repellent hamper pockets and the front pockets are sized to hold approximately an equivalent amount of items. Additionally, the water repellent hamper pockets may include a waterproof material.

20 Claims, 21 Drawing Sheets

(56) References Cited

U.S. PATENT DOCUMENTS

| | | | | | |
|---|---|---|---|---|---|
| 4,765,472 | A | * | 8/1988 | Dent | A47J 47/18 206/373 |
| 4,796,790 | A | * | 1/1989 | Hamilton | A45C 11/00 206/438 |
| 4,801,010 | A | | 1/1989 | Levitas | |
| 4,825,985 | A | | 5/1989 | Kim | |
| 4,830,154 | A | | 5/1989 | Gerch et al. | |
| 4,854,432 | A | | 8/1989 | Carpenter et al. | |
| 4,887,751 | A | | 12/1989 | Lehman | |
| 4,892,237 | A | | 1/1990 | Duester et al. | |
| 4,960,204 | A | * | 10/1990 | Young | A45C 3/00 190/109 |
| 5,046,620 | A | | 9/1991 | Barabino | |
| 5,050,998 | A | | 9/1991 | Wachtel | |
| D354,596 | S | * | 1/1995 | Dancyger | D32/53 |
| 5,503,476 | A | | 4/1996 | Hamdan | |
| 5,743,649 | A | | 4/1998 | Gonzalez | |
| 5,803,605 | A | | 9/1998 | Masi | |
| 6,047,752 | A | | 4/2000 | Southwick | |
| 6,183,133 | B1 | | 2/2001 | Roegner | |
| 6,193,034 | B1 | | 2/2001 | Fournier | |
| 6,223,870 | B1 | | 5/2001 | Godshaw | |
| 6,481,574 | B1 | | 11/2002 | Pakosh | |
| 6,561,329 | B2 | | 5/2003 | Stobbs, II et al. | |
| 6,644,475 | B2 | | 11/2003 | Wilson, II et al. | |
| 6,883,654 | B2 | | 4/2005 | Godshaw et al. | |
| 6,910,560 | B2 | | 6/2005 | Dulin | |
| 7,293,635 | B2 | | 11/2007 | Repke et al. | |
| 7,318,542 | B2 | | 1/2008 | Godshaw | |
| 7,562,408 | B1 | | 7/2009 | Johnson et al. | |
| 7,861,857 | B2 | | 1/2011 | Vorderkunz | |
| 7,886,786 | B1 | | 2/2011 | Christie | |
| 7,959,356 | B2 | | 6/2011 | Sommers | |
| 8,146,787 | B2 | | 4/2012 | Cragg | |
| 2002/0088679 | A1 | | 7/2002 | Abraham | |
| 2006/0037824 | A1 | | 2/2006 | Park et al. | |
| 2008/0020665 | A1 | | 1/2008 | Martin | |
| 2008/0179368 | A1 | | 7/2008 | Williams | |
| 2008/0237071 | A1 | | 10/2008 | Campillo et al. | |
| 2010/0276241 | A1 | | 11/2010 | Malone | |
| 2011/0132708 | A1 | | 6/2011 | DeLine et al. | |
| 2011/0168584 | A1 | | 7/2011 | Torrellas | |
| 2011/0192739 | A1 | | 8/2011 | Berglund | |
| 2011/0192740 | A1 | | 8/2011 | Berglund | |

* cited by examiner

GARMENT HOLDER AND HAMPER TRAVELER

CROSS-REFERENCE TO RELATED APPLICATIONS

The present application claims the benefit of priority to U.S. Provisional Patent Application No. 61/614,493 filed on Mar. 22, 2012.

BACKGROUND OF INVENTION

Embodiments are generally related to a garment holder and hamper insert. More particularly, embodiments are related to a garment and accessory holder and hamper for insertion in luggage or a carrying bag or for simply carrying as a stand-alone bag.

When traveling, people often times pack undergarments, bathing/shower accessories, and jewelry in separate luggage compartments. People, particularly women, may also be very conscientious about packing undergarments in such a way that when the luggage or carrying bag is opened, these items are not visible. For example, undergarments, bathing/shower accessories, and jewelry may typically be packed in several different types and sizes of bags, and then all of the bags may be placed inside the luggage or carrying bag with the hopes that they will remain in the location in which they were placed.

BRIEF DESCRIPTION OF THE DRAWINGS

The accompanying drawings, which are incorporated herein and form part of the specification, illustrate embodiments and, together with the description, further serve to explain the principles of the embodiments and to enable a person skilled in the pertinent art(s) to make and use the embodiments. In the drawings, like reference numbers generally indicate identical, functionally similar, and/or structurally similar elements.

DETAILED DESCRIPTION

While embodiments are described herein with reference to illustrative examples for particular applications, it should be understood that the embodiments are not limited thereto. Those skilled in the relevant art(s) with access to the teachings provided herein will recognize additional modifications, applications, and embodiments within the scope thereof and additional fields in which embodiments of the embodiments would be of significant utility.

Reference in the specification to "one embodiment," "an embodiment" or "another embodiment" means that a particular feature, structure or characteristic described in connection with the example may be included in at least one embodiment of the present invention. Thus, the appearances of the phrases "one embodiment," "an embodiment" or "another embodiment" in various places throughout the specification are not necessarily all referring to the same embodiment.

Embodiments may be directed to a garment holder and hamper traveler ("the traveler") that is comprised of a plurality of two-in-one-pocket compartments for both clean and soiled items and a plurality of other compartments for other personal items. Items that may be held in the two-in-one-pocket compartments may include, but are not limited to, undergarments, nightgowns, socks, stockings, etc. Items that may be held in the other compartments may include, but are not limited to, jewelry, bath/shower accessories, toiletries, make-up, slippers, etc. After packing, the traveler may be inserted in one's luggage or carrying bag, or the traveler may simply be carried. Once arriving at the destination, there may be no need to unpack the items from the traveler. The traveler may be hung and the items may be pulled from the traveler on an as-needed basis. After wearing an item that was taken from the traveler, that item, if soiled, may be placed in the hamper compartment of the two-in-one-pocket from which it was pulled. Such an approach may protect the clean items by keeping them separate from the soiled items. Furthermore, the soiled items may be prevented from exposure. Throughout the trip, any unused garments or unused items may remain packed. Once it is time to return home, all of the items that the person arrived with may already be packed in the traveler. More particularly, the clean items may already be packed separately from the soiled items. When preparing to leave one's destination, the traveler may be immediately placed in the luggage or carrying bag without the need to repack. In other words, the traveler may remain packed at all times during the entire stay, eliminating the need for one to repack before returning home. Rather than inserting the traveler in a piece of luggage or carrying bag, one may also carry the traveler by itself. The traveler may also be scented with one's fragrance of choice, which may permeate throughout the traveler, the luggage or carrying bag, and the area in which it is hung.

Figure 1:
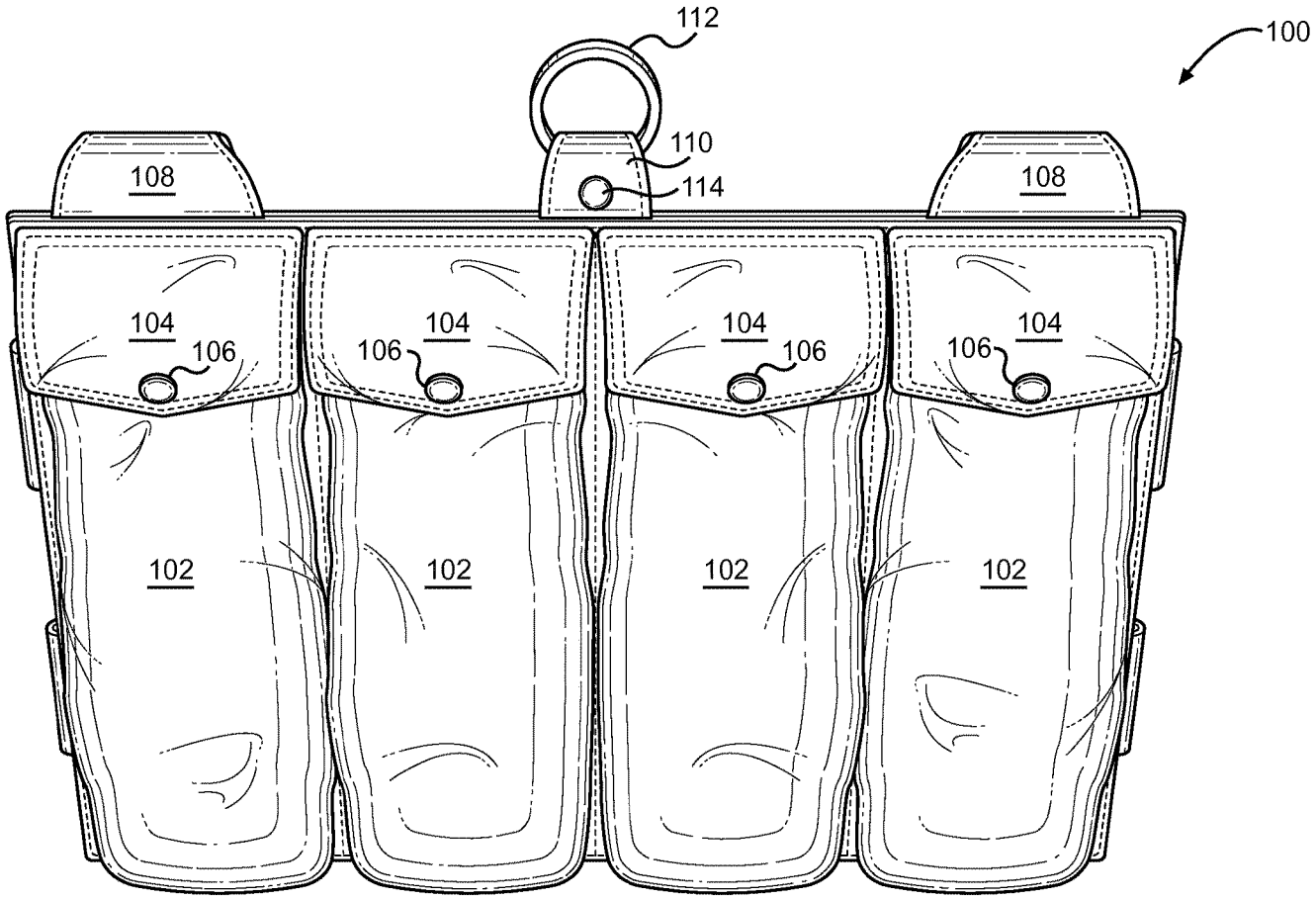
FIG. 1 is a perspective view of the front of an example of a garment holder and hamper traveler in accordance with an embodiment.

FIG. 1 is a front view of a garment holder and hamper traveler (a "traveler") 100 in accordance with an embodiment of the present invention. As shown in FIG. 1, the front of the traveler 100 comprises a plurality of front two-in-one-pockets 102 for holding various items. Although four pockets are shown in FIG. 1, the front of the traveler 100 is not limited to four pockets 102. In other embodiments, there may be more than or less than four pockets 102, and the size of pockets 102 may vary. When the traveler 100 contains more pockets, the size of the traveler 100 may or may not increase. When the traveler 100 contains less pockets, the size of the traveler 100 may or may not decrease. Each illustrated pocket 102 includes a flap 104 having a fastener 106 to allow the pocket 102 to close securely. The number of fastener 106 may vary depending on the size of flap 104.

The illustrated traveler 100 also includes two hanging straps 108, placed on a top portion of the traveler 100. The straps 108 may be made of a stretchable fabric or material, a non-stretchable fabric or material, and so forth. The straps 108 may also be made of durable, waterproof, or water repellent fabric or material. The straps 108 may enable the traveler 100 to attach to a horizontal rod or bar. For example, the straps 108 may attach to a hanger as described below with reference to FIG. 16, to a towel bar as described below with reference to FIG. 23A, to a shower rod as described below with reference to FIG. 23B, and so forth. The straps 108 may extend and fasten over (e.g., wrap around) a rod of the hanger or shower or a bar. In one embodiment, snaps may be used to fasten the straps 108 around the rod of the hanger or shower or a bar. In another embodiment, hook and loop fastener (e.g., Velcro®) may be used to fasten the straps 108 around the rod of the hanger or shower or bar. Depending upon the number of pockets 102 of the traveler 100, the size, number and position of the straps 108 may vary.

The illustrated traveler 100 also includes a loop 110 attached to the top of the traveler 100. In one embodiment, the loop 110 may be comprised of a durable material, such as, but not limited to, leather, nylon, a stretchable fabric or material, a non-stretchable fabric or material, etc. In another embodiment, the loop 110 may be comprised of a durable, waterproof and or water repellent fabric or material, etc. A ring 112 may be connected to loop 110 and secured to it by a snap 114 or other material. In an alternative embodiment, snap 114 may be eliminated and therefore loop 110 may be sewn in a manner that enables ring 112 to be secured to loop 110. In one embodiment, the ring 112 may be connected to a chain and hook for hanging the traveler, as described below with reference to FIG. 17. In another embodiment, the ring 112 may be coupled to a hanger, as described below with reference to FIGS. 18 and 19. In yet another embodiment, the ring 112 may be connected to a leather strap or rope for carrying the traveler 100 as a stand-alone carrying bag, which is described below with reference to FIGS. 13A and 13B. The ring 112 may be comprised of a solid material, such as, but not limited to, rubber, metal, etc.

The body of traveler 100 may comprise a durable, stretchable fabric or material or a non-stretch fabric or material, such as, but not limited to nylon, etc. In one example, the body of the traveler 100 may comprise a durable, waterproof and/or water resistant fabric or material such as, for example, PEVA (polyethylene vinyl acetate), nylon with waterproof coating, breathable waterproof fabric, and so forth. The pockets 102 may also comprise a durable, stretchable fabric or material, or a non-stretchable fabric or material, such as, but not limited to nylon, etc. In another embodiment the pockets 102 may also comprise a durable waterproof, pr water resistant, or water repellent fabric or material. In another embodiment, the pockets 102 may be sewn to expand when filled. In another embodiment, the pockets 102 may contain a mesh or netting material.

Figure 2:
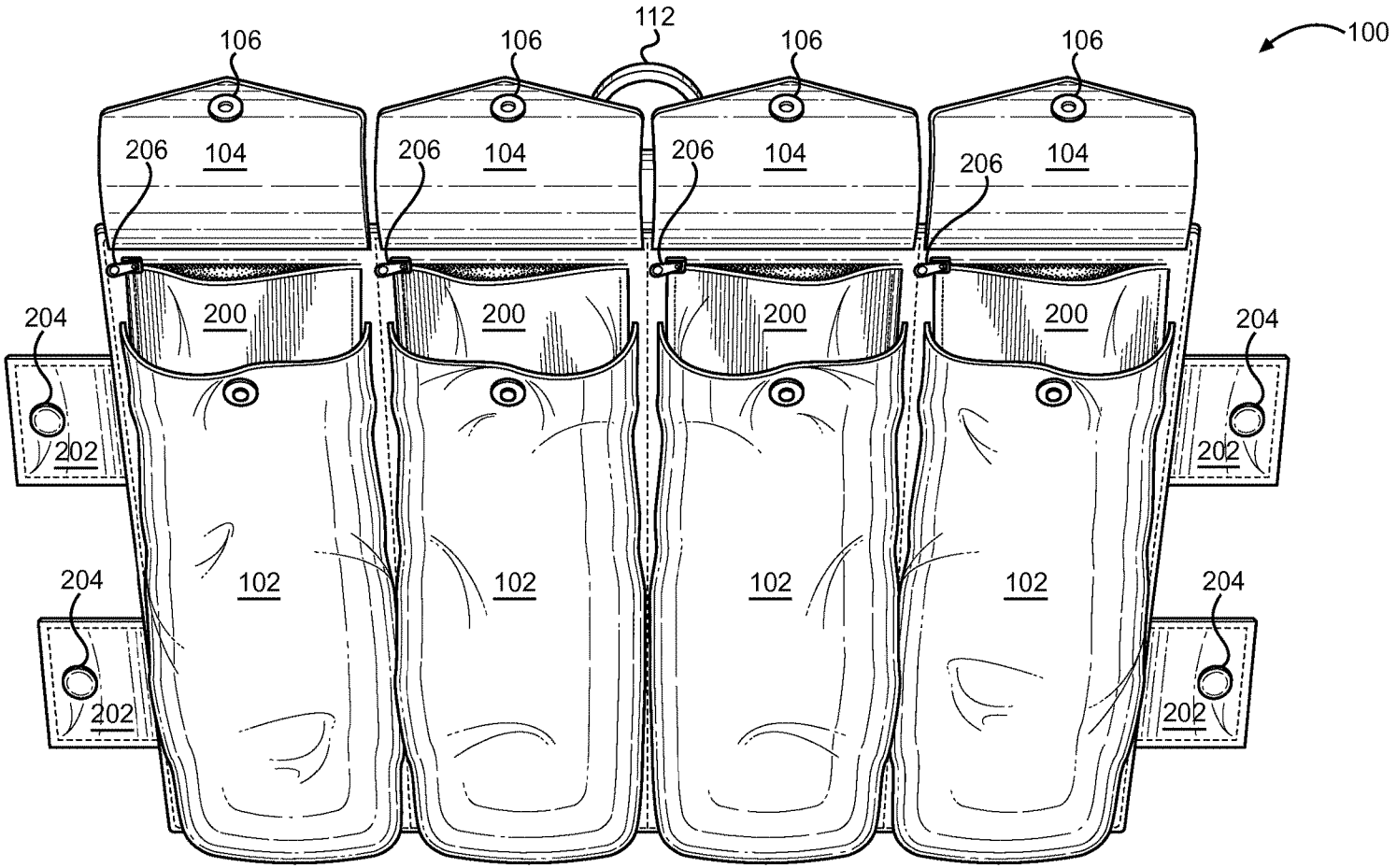
FIG. 2 is a perspective view of the front of the example of the garment holder and hamper traveler of FIG. 1 with front pockets opened in accordance with an embodiment.

FIG. 2 is a front view of the traveler 100 with the front two-in-one-pockets 102 opened in accordance with an embodiment. As shown in FIG. 2, the traveler 100 comprises a plurality of hamper pockets 200 inside of the pockets 102. The pockets 102 may be used to hold clean items. The hamper pockets 200, on the other hand, may be used for holding soiled or damp items. The hamper pockets 200 may be made of a durable material that prevents leakage (e.g., PEVA, or other waterproof material or fabric). The durable material may be stretchable, or non-stretchable. Although four hamper pockets 200 are shown in FIG. 2, the traveler 100 is not limited to four hamper pockets 200. In other embodiments, there may be more than or less than four hamper pockets 200 and the size of pockets 200 may vary. In another embodiment, the number of hamper pockets 200 may equal the number of pockets 102. The pockets 102 may also be sewn to expand when filled. In this regard, the hamper pockets 200 and the pockets 102 (e.g., outer front pockets) may be sized to hold approximately an equivalent amount of items. Such a configuration may enable clean items to be transferred from the outer pockets 102 to the hamper pockets 200 as they become soiled without concern over running out of room in the hamper pockets 200. Each hamper pocket 200 may be securely closed using zippers 206 to separate the damp or soiled items from the clean items inserted in the pockets 102. In one embodiment, snaps may be used to securely close the hamper pockets 200. In an alternative embodiment, hook and loop fastener may be used to close the hamper pockets 200. The tops of the pockets 102 may also contain elastic to make them more secure when holding loose items.

As shown in FIG. 2, the traveler 100 also comprises side fasteners 202. In an embodiment, the side fasteners 202 may be snapped to the back of the traveler 100. In an alternative embodiment, hook and loop fastener may be used to attach the side fasteners 202 to the back of the traveler 100. In another embodiment, the side fasteners 202 may be used to secure traveler 100 when folded in half, as described below with reference to FIG. 12. The side fasteners 202 may include snaps 204 to connect the side fasteners 202 to one another. In an alternative embodiment, hook and loop fastener may be used to connect the side fasteners 202 to one another.

Figure 3:
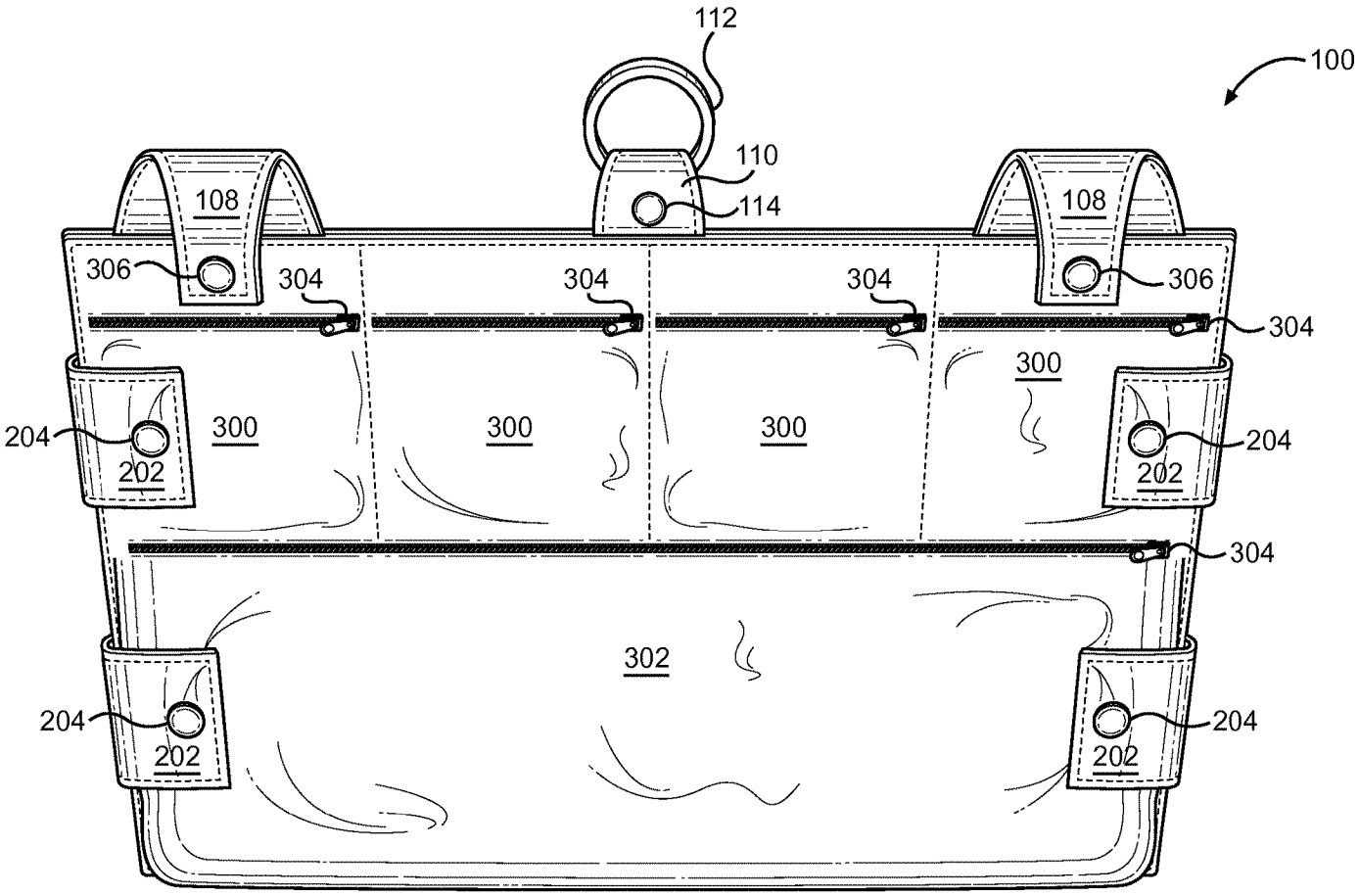
FIG. 3 is a perspective view of the back of an example of a garment holder and hamper traveler in accordance with an embodiment.

FIG. 3 is a rear view of the traveler 100 in accordance with an embodiment of the present invention. As shown in FIG. 3, the rear of the traveler 100 comprises a plurality of pockets 300 and 302 for holding a plethora of various items. Pockets 300 and 302 may be used to hold jewelry, bath/shower accessories, toiletries, make-up, slippers, etc. Pockets 300 and 302 are made of a durable, non-stretchable or stretchable fabric or material. In another embodiment, the pockets 300 and 302 may also be made of a durable, waterproof, or water resistant, or water repellent fabric or material. Although five pockets are shown in FIG. 3, the back of the traveler 100 is not limited to five pockets. In other embodiments, there may be more or less than five pockets, and the size of the pockets may vary. When the traveler 100 contains more pockets, the size of the traveler 100 may increase. When the traveler 100 contains less pockets, the size of the traveler 100 may decrease. The pockets 300 and 302 are securely closed with zippers 304. In the illustrated example, the pocket 302 has a width that is approximately equal to the width of the traveler 100. Such a configuration may enable garments such as small tops and shorts to be stored along-side, for example, smaller toiletries. In one embodiment, snaps may be used to securely close the pockets 300 and 302. In an alternative embodiment, hook and loop fastener may be used to close the pockets 300 and 302. FIG. 3 shows fasteners 202 and snaps 204 affixed to the back of the traveler 100. FIG. 3 also shows hanging straps 108 fastened to the rear of the traveler 100 by snaps 306.

Figure 4:
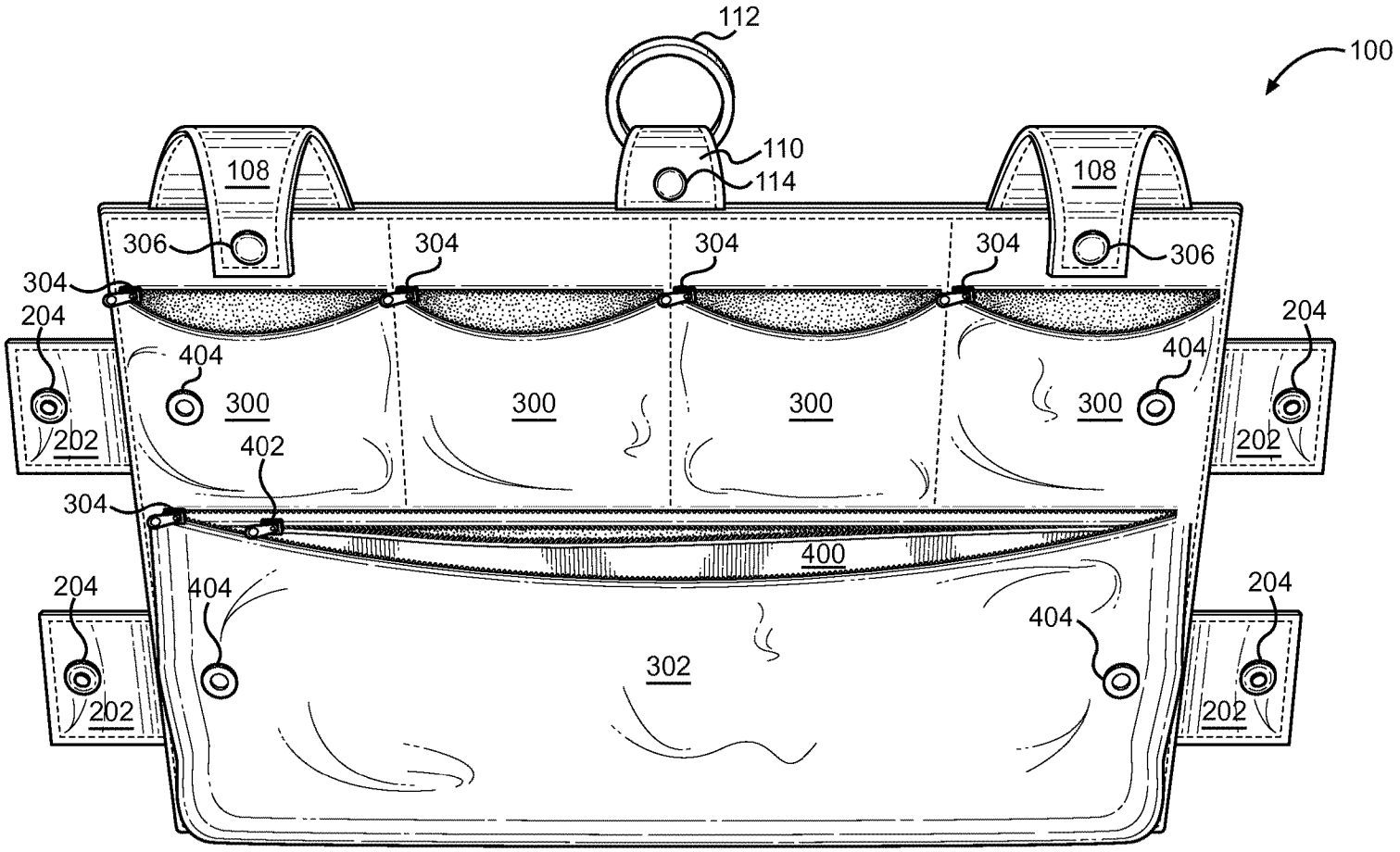
FIG. 4 is a perspective view of the back of an example of a garment holder and hamper traveler of FIG. 3 with back pockets opened in accordance with an embodiment.

FIG. 4 is a rear view of the traveler 100 with the pockets 300 and 302 opened in accordance with an embodiment of the present invention. As shown in FIG. 4, the traveler 100 comprises pockets 300 that may be used to carry various items, such as, for example, jewelry and other accessories (shown below with reference to FIG. 11). The traveler 100 also comprises a pocket 302 that may be used to carry items, such as, for example, a hairbrush, comb, and make-up (shown below with reference to FIG. 11). In one embodiment, the pocket 302 may comprise a back two-in-one-pocket similar to the pockets 102. As shown in FIG. 4, the pocket 302 comprises a hamper pocket 400. The pocket 400 may therefore be made of a durable, water resistant and/or waterproof material or fabric that prevents leakage. The durable material may be non-stretchable or stretchable. The pocket 400 may also be used to carry other items, such as, for example bath/shower accessories and toiletries (shown below with reference to FIG. 11). Although one pocket 400 is shown in FIG. 4, the back of the traveler 100 is not limited to one pocket 400. In other embodiments, there may be more than one pocket 400. The illustrated pocket 400 is securely closed with a zipper 402. In one embodiment, snaps may be used to securely close pocket 400. In an alternative embodiment, hook and loop fastener may be used to close the pocket 400. FIG. 4 also shows snaps 404 and 204 that may be used to attach the side fasteners 202 to rear of the traveler 100. In an alternative embodiment, hook and loop fastener may be used to attach the side fasteners 202 to the rear of the traveler 100.

Figure 5:
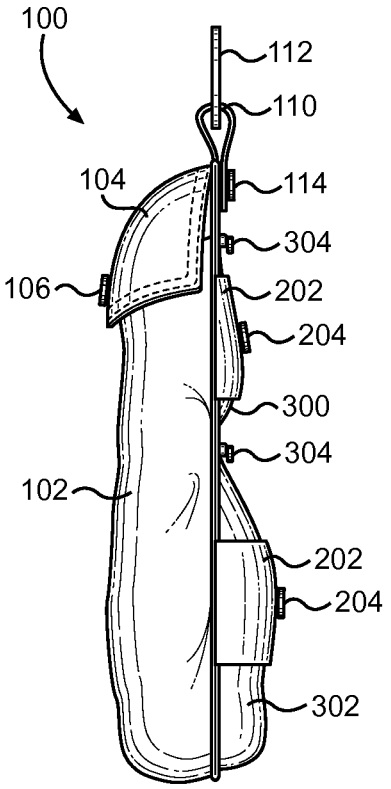
FIG. 5 is a perspective view of the right side of an example of a garment holder and hamper traveler in accordance with an embodiment.
Figure 6:
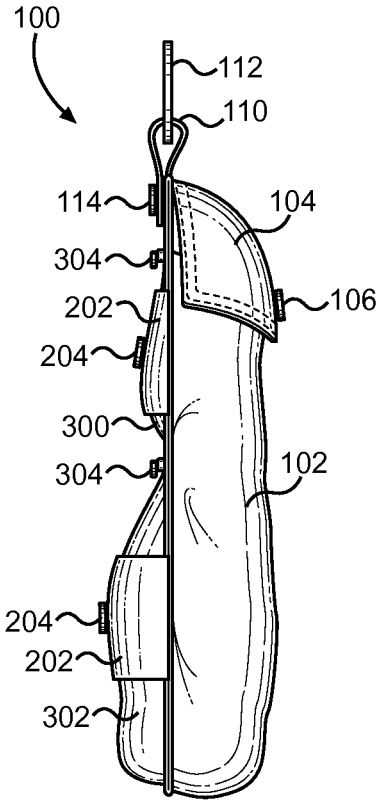
FIG. 6 is a perspective view of the left side of an example of a garment holder and hamper traveler in accordance with an embodiment.

FIGS. 5 and 6 are side views of the traveler 100 in accordance with an embodiment. FIG. 5 shows a right side view of the traveler 100. FIG. 6 shows a left side view of the traveler 100.

Figure 7:
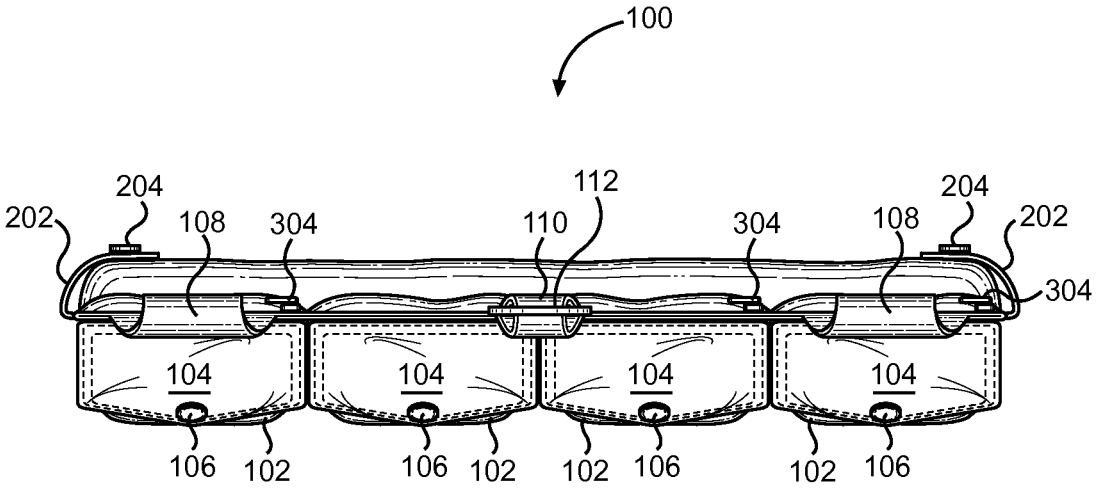
FIG. 7 is a perspective view of the top of an example of a garment holder and hamper traveler in accordance with an embodiment.
Figure 8:
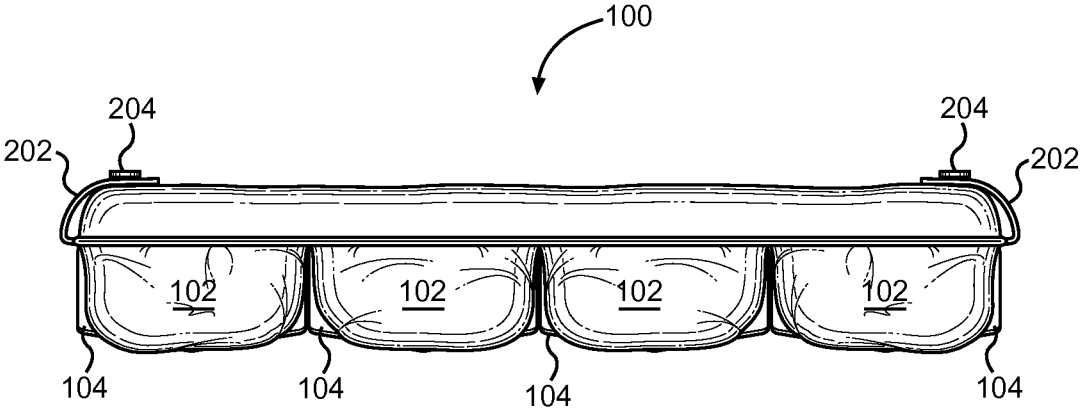
FIG. 8 is a perspective view of the bottom of an example of a garment holder and hamper traveler in accordance with an embodiment.

FIGS. 7 and 8 are top and bottom views of the traveler 100 in accordance with an embodiment. FIG. 7 is a top view of the traveler 100. FIG. 8 is a bottom view of the traveler 100.

Figure 9:
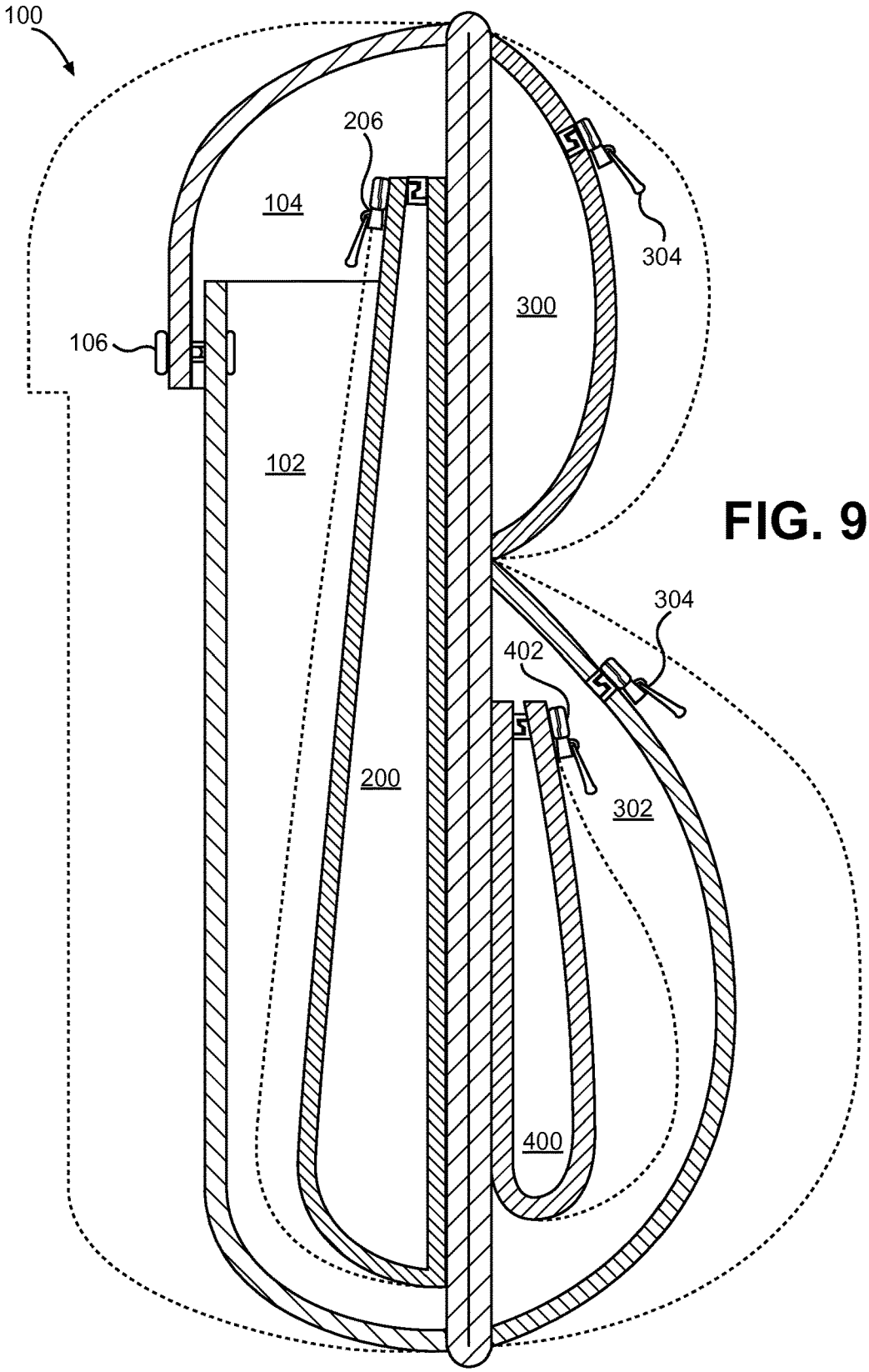
FIG. 9 is a perspective view of the inside of an example of a garment holder and hamper traveler in accordance with an embodiment.

FIG. 9 is an inside view of the traveler 100 in accordance with an embodiment. As noted earlier, with reference to FIG. 2, FIG. 9 shows hamper pocket 200 securely closed via zipper 206. This enables clean items that may be inserted in the outer front pocket 102 to be protected from soiled items that may be placed in the inner hamper pocket 200. In an embodiment where the back pocket 400 is used as a hamper pocket, the zipper 402 securely closes the hamper pocket 400 to keep soiled items separate from items that may be inserted in the pocket 302. In another embodiment, the pocket 400 may be used for purposes other than a hamper. One may want to protect certain materials from touching items that may cause harm. For example, one may want to put a comb and brush in pocket 400 and stockings in pocket 302. By securely closing pocket 400 via zipper 402, pocket 400 prevents the comb and brush from snagging the stockings inserted in pocket 302. In another example, one may use pocket 400 to place bath/shower items, such as, for example a body brush, loofah pad, face sponge, etc., separate from any other items for sanitary or hygiene purposes. Although pocket 400 has been described as being used to separate certain items from other items inserted in pocket 302, the embodiments are not so limited. The pocket 400 may be used for other purposes. One of ordinary skill in the art will understand that pocket 400 may be used for purposes other than to separate items for protection or hygiene reasons. The dash lines around the pockets of the traveler 100 in FIG. 9 illustrate how the durable material of the traveler 100 may expand when filled with items.

Figure 10:
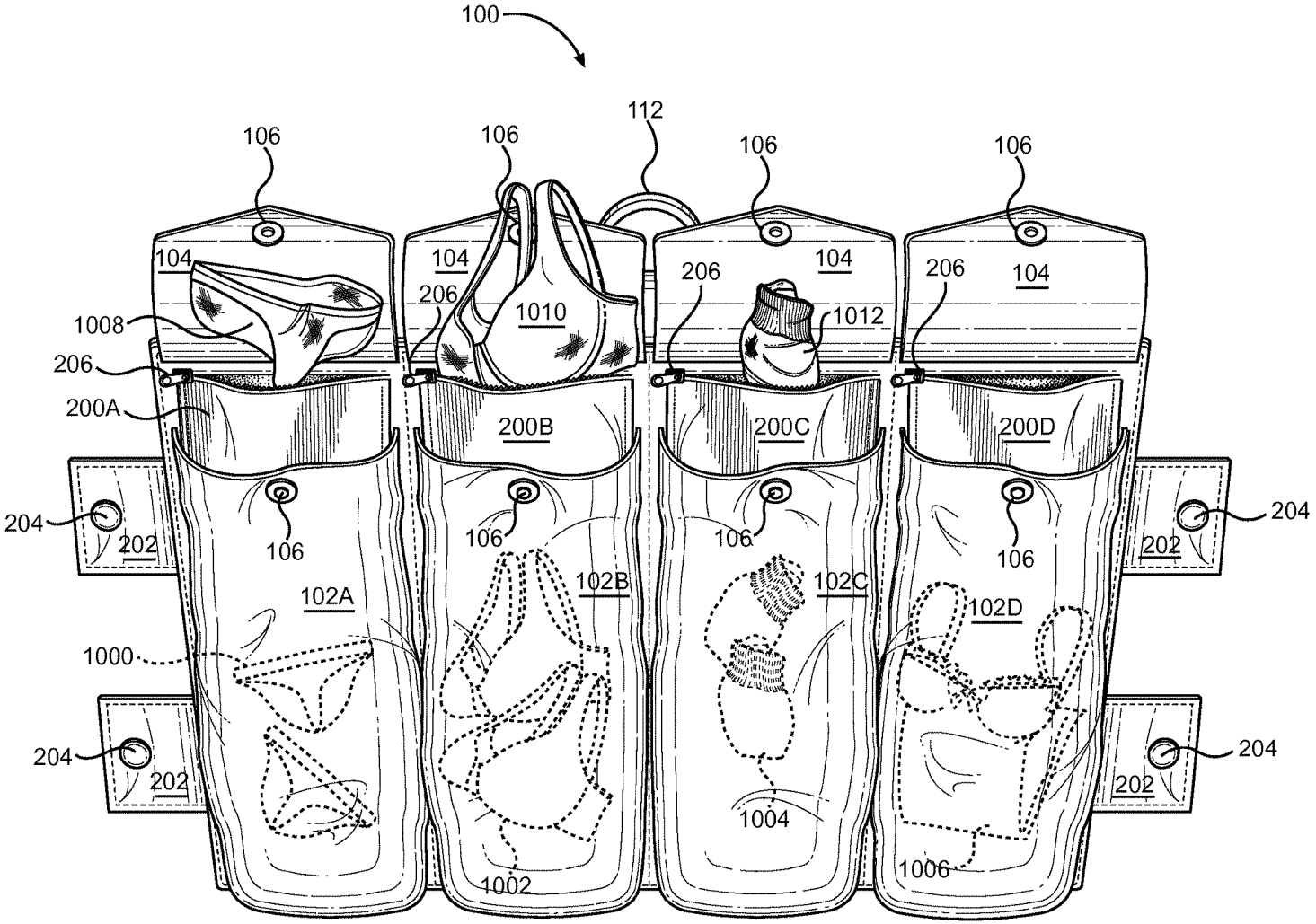
FIG. 10 is a perspective view of an example of a garment holder and hamper traveler illustrating its use in accordance with an embodiment.

FIG. 10 is a perspective view of the traveler 100 illustrating its use in accordance with an embodiment. FIG. 10 shows clean garments 1000, 1002, 1004, and 1006 packed inside of pockets 102A, 102B, 102C, and 102D of the traveler 100. Garments 1000, 1002, 1004, and 1006 were packed in preparation for travel. Pocket 102A contains a plurality of clean panties 1000. Pocket 102B contains a plurality of clean bras 1002. Pocket 102C contains a plurality of clean socks 1004. Pocket 102D contains a clean nightgown 1006. FIG. 10 also shows soiled undergarments 1008, 1010, and 1012 being inserted inside hamper pockets 200A, 200B, and 200C, respectively. In an embodiment, soiled panties 1008 are shown being inserted in hamper pocket 200A. A soiled bra 1010 is shown being inserted in hamper pocket 200B. A soiled pair of socks 1012 are shown being inserted in hamper pocket 200C. The hamper pockets 200 may be made of a material that prevents leakage and odor seepage.

For example, one may pull clean panties from pocket 102A, a clean bra from pocket 102B, and clean socks from pocket 102C and wear them. Prior to retiring for bed, one may take off the worn items and insert them in the corresponding hamper pockets 200 of the traveler 100. After taking off soiled panties 1008, one may immediately insert soiled panties 1008 in hamper pocket 200A. In a similar manner, after taking off soiled bra 1010 and soiled socks 1012, one may immediately insert them into hamper pockets 200B and 200C, respectively. After inserting soiled undergarments 1008, 1010, and 1012, one may pull clean gown 1006 from pocket 102D of the traveler 100 to wear to bed. By packing soiled garments 1008, 1010, and 1012 in hamper pockets 200A, 200B, and 200C, respectively, and immediately securing the soiled items inside of hamper pockets 200A, 200B, and 200C by closing zippers 206, the clean garments already packed in pockets 102A, 102B, 102C, and 102D remain protected.

Although FIG. 10 shows undergarments and a nightgown packed in pockets 102A, 102B, 102C, and 102D of the traveler 100, one skilled in the art would know that other small garments or items (e.g., swimwear) may be packed inside pockets 102A, 102B, 102C, and 102D of the traveler 100. Although female garments are shown, the traveler 100 is not limited to use by females. One skilled in the art would know that the traveler 100 may be used to pack items used by males. Male items that may be packed in the traveler 100 include such items as, for example, boxer shorts instead of panties in pocket 102A, T-shirts instead of bras in pocket 102B, and male sleep wear instead of a night gown in pocket 102D.

Figure 11:
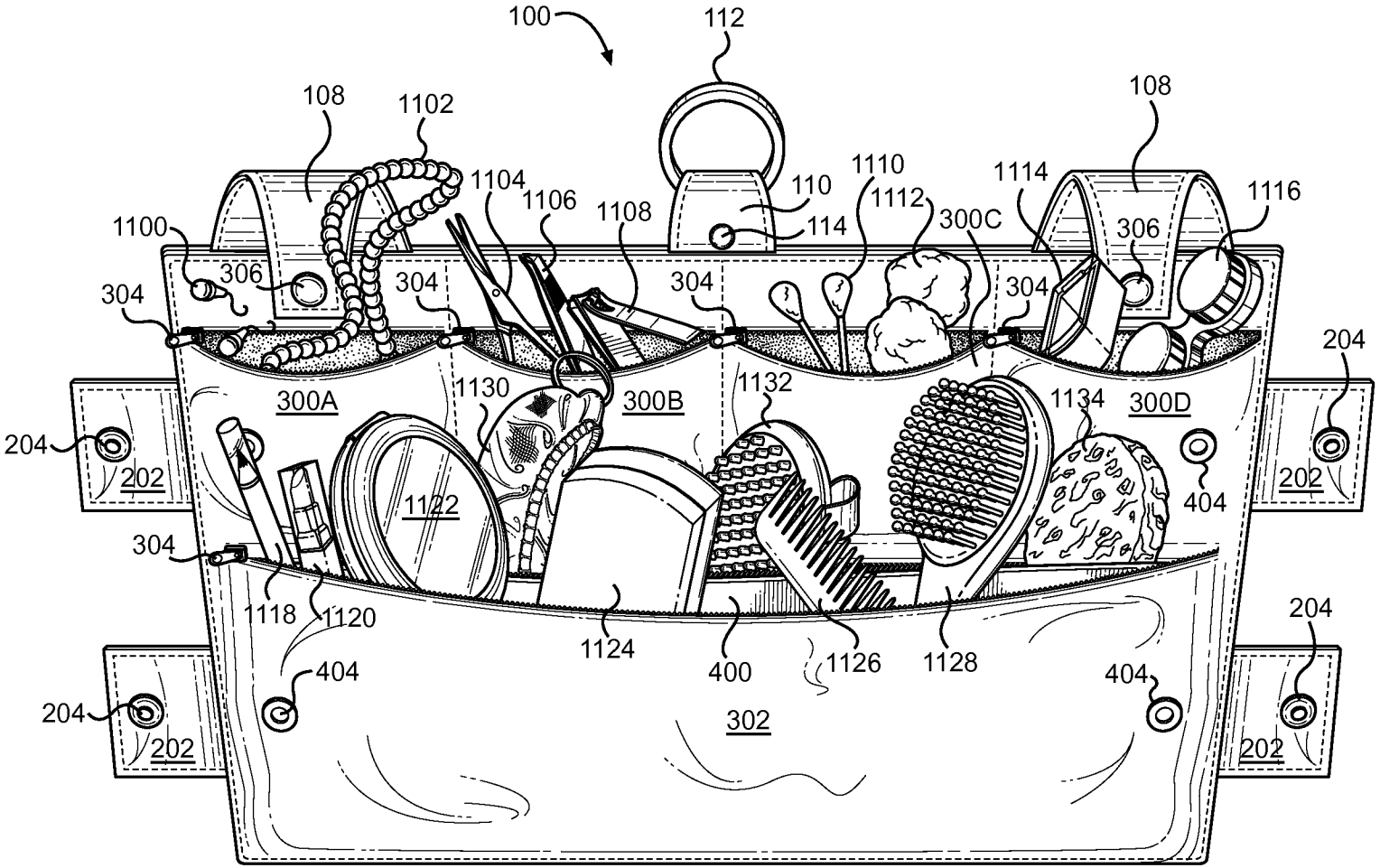
FIG. 11 is a perspective view of an example of a garment holder and hamper traveler illustrating its use in accordance with an embodiment.

FIG. 11 is a perspective view of the traveler 100 illustrating its use in accordance with an embodiment of the present invention. As shown in FIG. 11, one may pack a plethora of items inside pockets 300A, 300B, 300C, 300D, and 302. FIG. 11 shows jewelry 1100 and 1102, small scissors 1104 (potentially packaged to prevent puncture of the surrounding fabric/material), tweezers 1106, nail clippers 1108, Q-Tips 1110, cotton balls 1112, a pill container 1114, and a contact lens case 1116 packed in pockets 300A, 300B, 300C, and 300D of the traveler 100 in preparation for travel. FIG. 11 also shows eyeliner pencil 1118, lipstick 1120, make-up compact 1122, soap container 1124, hair comb 1126, and hair brush 1128 packed in pocket 302 of the traveler 100 in preparation for travel. While on travel, one may pull items from any of pockets 300 and 302, use them, and then reinsert them in the pocket from which pulled after use.

Although FIG. 11 shows specific items packed in pockets 300A, 300B, 300C, 300D, and 302 of the traveler 100, one skilled in the art would know that other items may be packed inside pockets 300A, 300B, 300C, 300D, and 302. In addition to those shown in FIG. 11, one may pack, such as, for example, a tooth brush, tooth paste, and floss or other small garments (as shown in reference to FIG. 24) in pocket 302 of traveler 100. Although certain items for females are shown, the traveler 100 is not limited to use by females. One skilled in the art would know that the traveler 100 may be used to pack items for males, such as, for example, a watch and cuff links instead of women's jewelry may be inserted in pocket 300A, and a razor, razor blades (potentially packaged to prevent puncture), and shaving cream instead of make-up may be inserted in pocket 302 of the traveler 100.

FIG. 11 also shows a shower cap 1130, body brush 1132, and face sponge 1134 packed in pocket 400 of the traveler 100 in preparation for travel. The illustrated pocket 400 is located inside of pocket 302. The pocket 400 may therefore be used as a hamper pocket or as a protector pocket. When used as a hamper pocket, as shown above with reference to FIG. 10, one may place soiled or used items inside of hamper pocket 400. When used as a protector pocket, one may pack inside pocket 400 items to be protected from the items that may be inserted into pocket 302. Specifically, for sanitary reasons, one may want to pack items used to wash one's face and body separate from make-up items. For example, one may prefer to pack a body brush 1132 and face sponge 1134 in pocket 400 separate from one's make-up, such as, for example, eyeliner pencil 1118, lipstick 1120, and make-up compact 1122. Items packed in pocket 400 may be secured by closing the zipper 402 (shown above with reference to FIG. 4). The items already packed in the pocket 302 remain dry and protected. The pocket 400 may be made of a material that prevents leakage or odor seepage. Although FIG. 11 shows specific items packed in the pocket 400 of the traveler 100, one skilled in the art would understand that other items may be packed inside pocket 400, such as, for example liquid toiletries, as shown in reference to FIG. 24.

Figure 12:
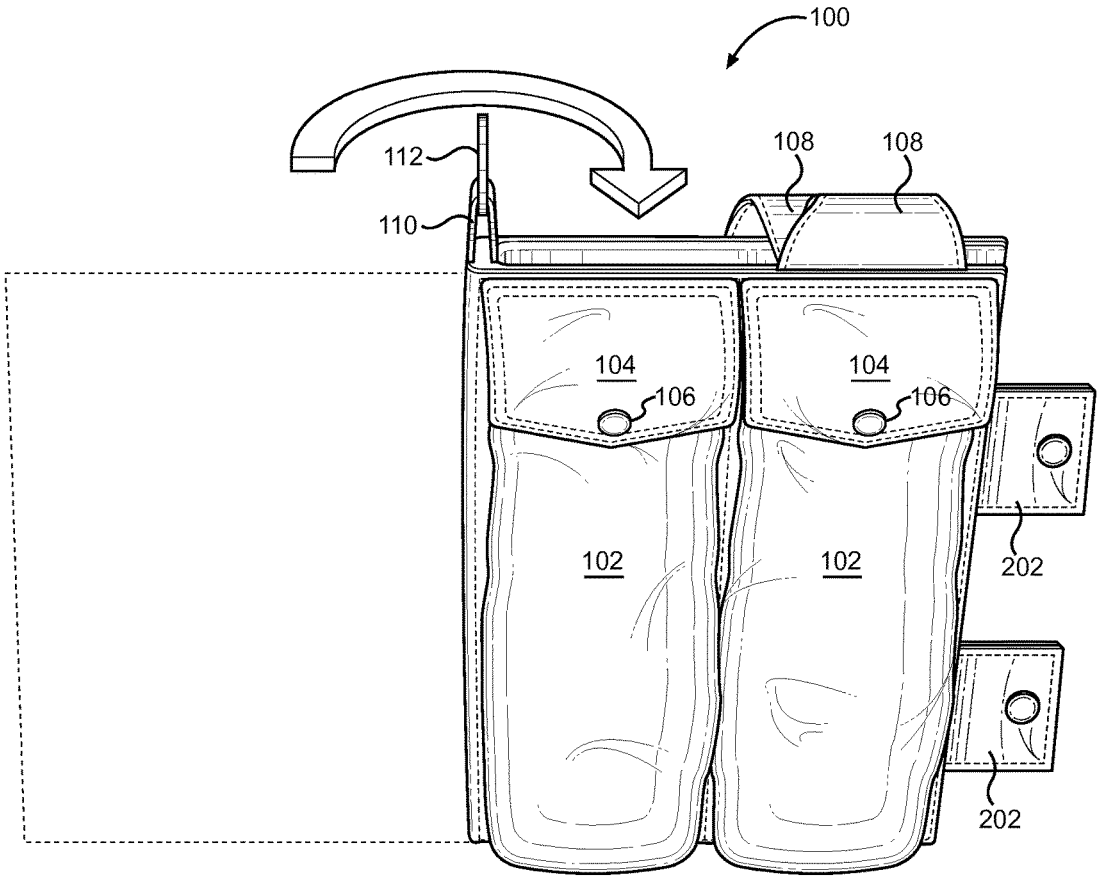
FIG. 12 is a perspective view of an example of a garment holder and hamper traveler folded in accordance with an embodiment.

The traveler 100 may be folded in half (e.g., transitioned from an enlarger state to a reduced state), allowing it to easily fit inside of a smaller piece of luggage or carrying bag. FIG. 12 illustrates the traveler 100 folded in accordance with an embodiment. The traveler 100 may be folded in half and kept closed (e.g., in the reduced state) by connecting fasteners 202 with snaps 204. The fabric of the traveler 100 may make it easy to fold even when filled with items. In an embodiment in which the traveler 100 is carried as a stand-alone bag, folding the illustrated traveler 100 makes for easy carrying.

As indicated above, the traveler 100 may be used as a stand-alone bag. FIG. 13A illustrates a method for carrying the traveler 100 as a stand-alone bag in accordance with an embodiment of the present invention. As shown in FIG. 13A, a rope 1300 may be connected to the ring 112 via a hook 1304 coupled to a clasp 1302 and a ring 1306. In another embodiment, the rope 1300 may vary in length. In another embodiment, the rope 1300 may be made of various types of material, such as, for example, nylon. The traveler 100 may be carried by holding the rope 1300 in one's hand, around one's wrist, or over one's shoulder.

Figure 13B:
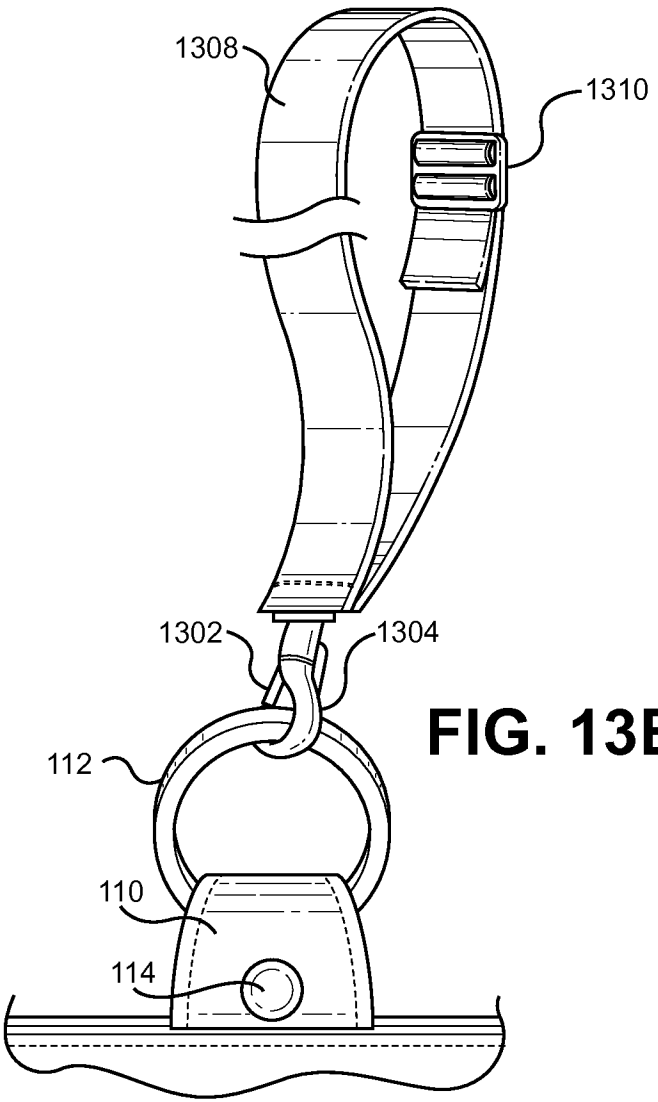
FIG. 13B is an alternative perspective view of a mechanism by which an example of a garment holder and hamper traveler may be carried in accordance with an embodiment.
Figure 13A:
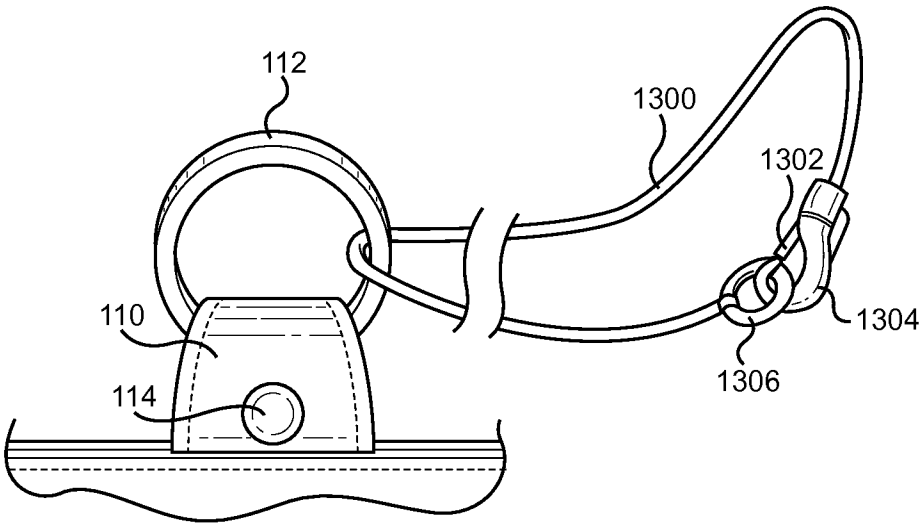
FIG. 13A is a perspective view of a mechanism by which an example of a garment holder and hamper traveler may be carried in accordance with an embodiment.

FIG. 13B illustrates another method for carrying the traveler 100 as a stand-alone bag in accordance with an embodiment of the present invention. As shown in FIG. 13B, a loop-shaped strap 1308 is connected to the ring 112 via a hook 1304 coupled to a clasp 1302. In another embodiment, the strap 1308 may vary in length by adjusting one or more buckle 1310 and/or the strap 1308. The strap 1308 may be made of various types of material, such as, for example, leather, vinyl, etc. In another embodiment, the size of the buckle 1310 may vary, and the buckle 1310 may be made of various types of material, such as, for example, metal, plastic, etc. The traveler 100 may be carried by holding the strap 1308 in one's hand, around one's wrist, or over one's shoulder.

Figure 14:
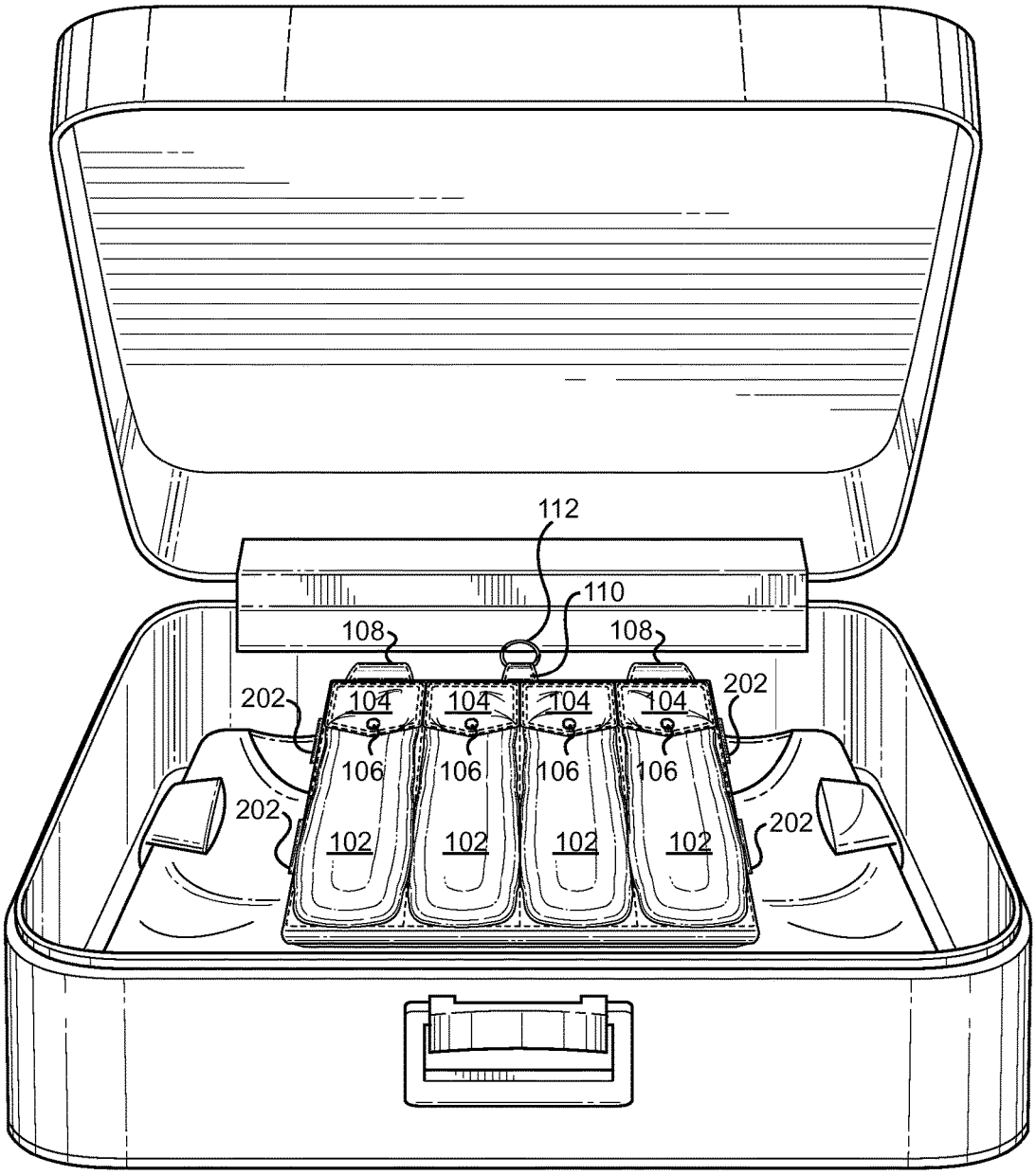
FIG. 14 is a perspective view of an example of a garment holder and hamper traveler being inserted in a piece of luggage in accordance with an embodiment.

FIG. 14 illustrates another method for carrying the traveler 100 in accordance with an embodiment of the present invention. As shown in FIG. 14, the traveler 100 may be inserted inside a piece of luggage. Although not shown, one may also insert the traveler 100 in a large side pocket of a piece of luggage. The illustrated traveler 100 keeps all the items exactly as packed in the luggage while traveling.

Figure 15:
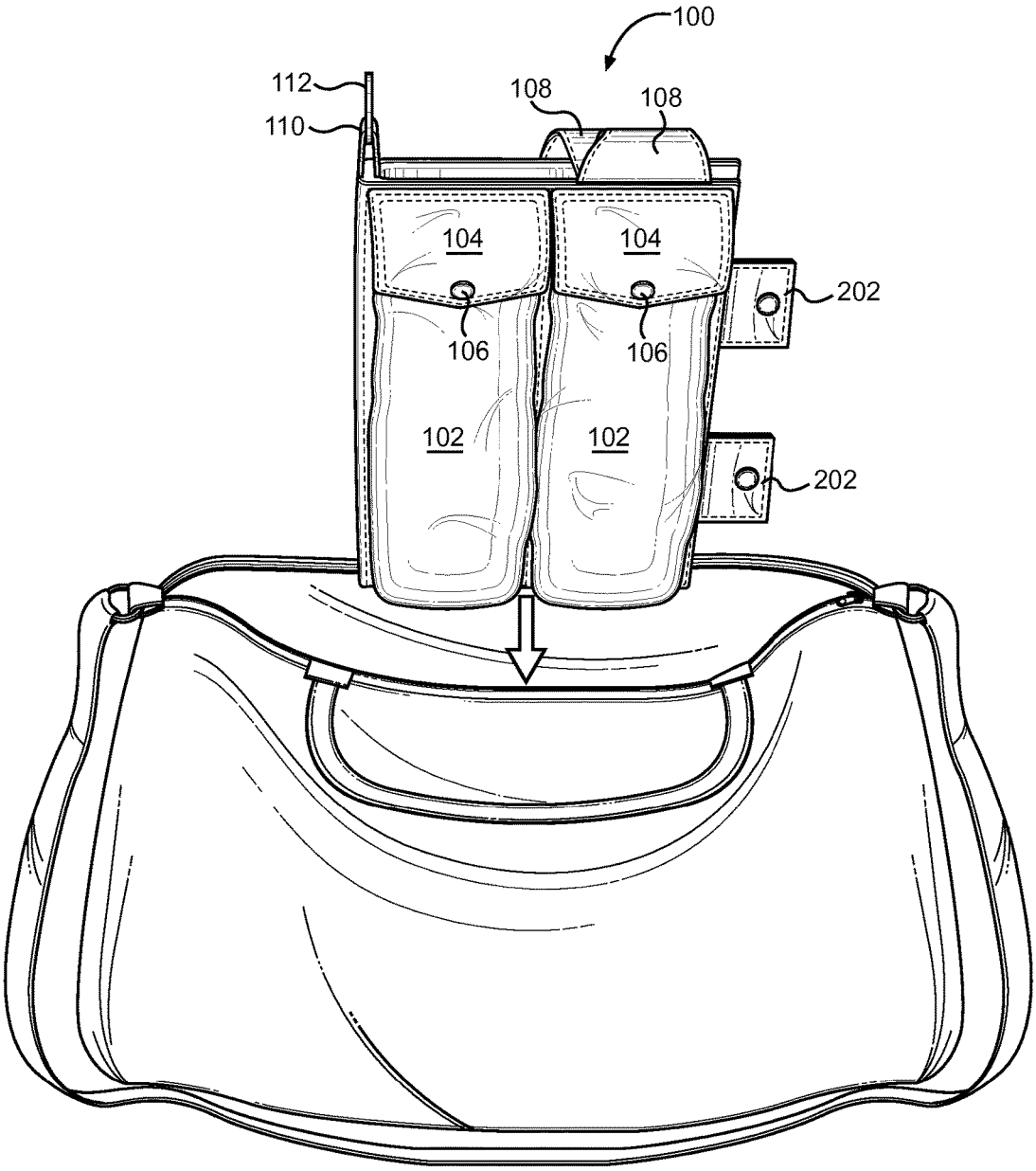
FIG. 15 is a perspective view of an example of a garment holder and hamper traveler being inserted in a carrying bag in accordance with an embodiment.

FIG. 15 illustrates another method for carrying the traveler 100 in accordance with an embodiment of the present invention. As shown in FIG. 15, the traveler 100 may be folded and inserted in a carrying bag. Although not shown, the traveler 100 folded may be inserted in a large pocket of a carrying bag. The traveler 100 may also lie flat, as shown in FIG. 14, and be inserted in a carrying bag. The traveler 100 keeps all the items exactly as packed in the carrying bag while traveling.

Figure 17:
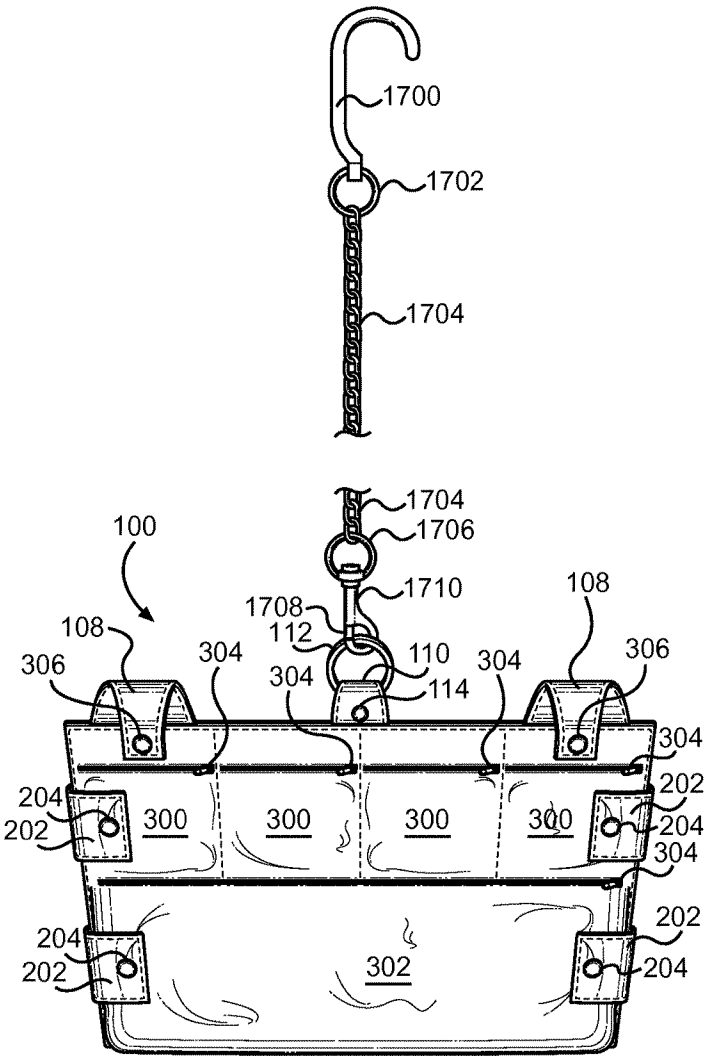
FIG. 17 is perspective view of an example of a garment holder and hamper traveler attached to a chain and hook in accordance with an embodiment.
Figure 16:
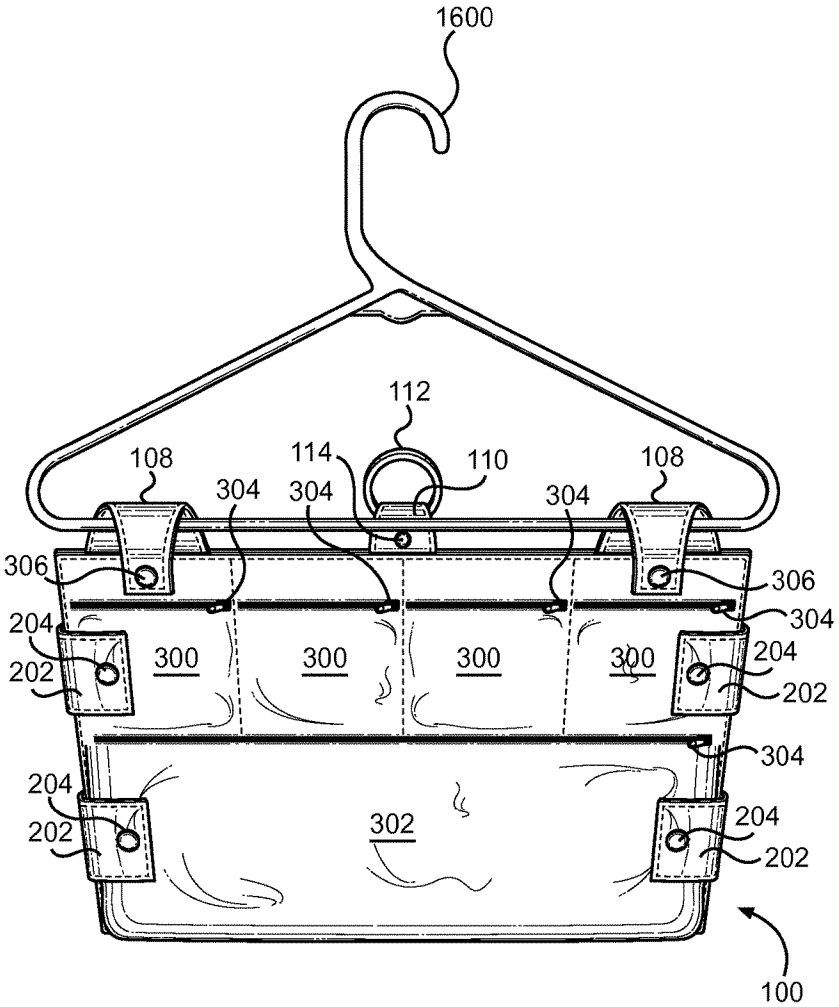
FIG. 16 is a perspective view of an example of a garment holder and hamper traveler attached to a hanger in accordance with an embodiment.
Figure 19:
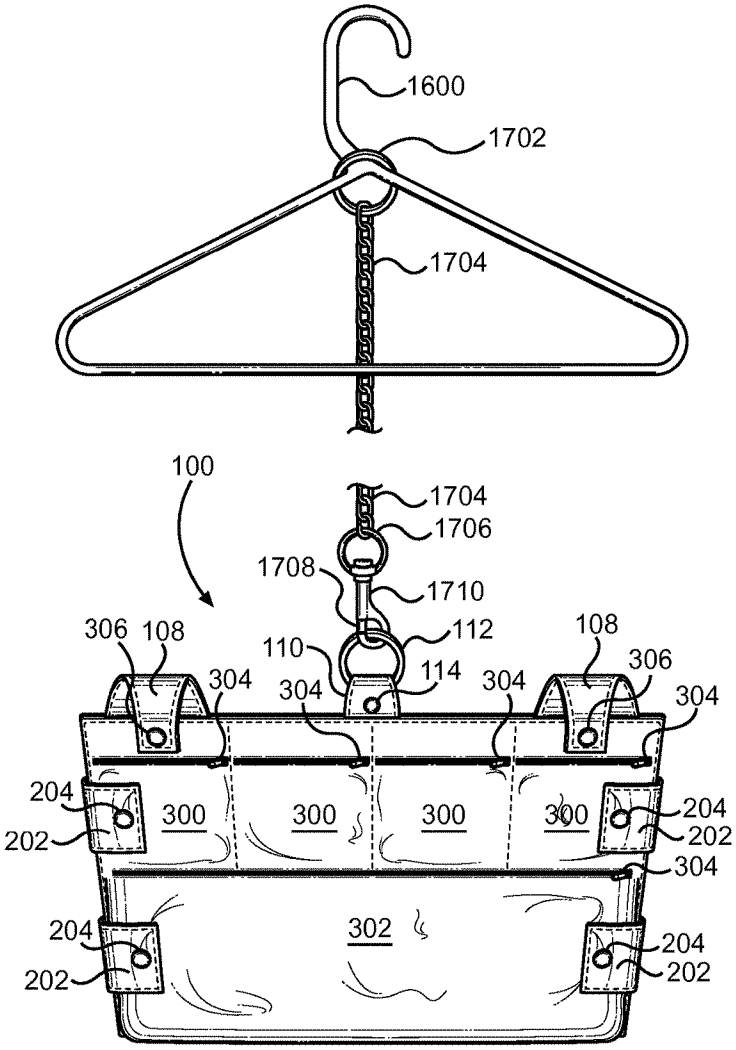
FIG. 19 is a perspective view of an example of a garment holder and hamper traveler attached to a chain and hanger in accordance with an alternative embodiment.
Figure 18:
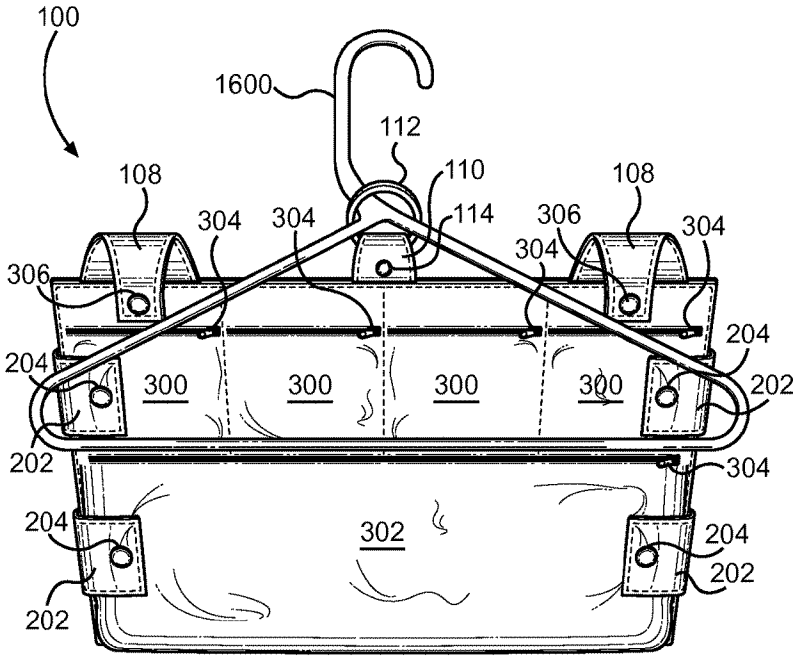
FIG. 18 is a perspective view of an example of a garment holder and hamper traveler attached to a hanger in accordance with an alternative embodiment.

FIGS. 16 and 17 illustrate methods for hanging the traveler 100 in accordance with an embodiment of the present invention. FIG. 16 shows the traveler 100 attached to a rod of a hanger 1600 using straps 108 and snaps 306. FIG. 17 shows an alternative embodiment for hanging the traveler 100. As shown in FIG. 17, the traveler 100 is hung by a chain 1704 and a hook 1700. The top of the chain 1704 may be connected to the hook 1700 via a ring 1702. The bottom of the illustrated chain 1704 is connected to the ring 112 of the traveler 100 via a hook 1710 and a clasp 1708 attached to a ring 1706. In another embodiment, chain 1704 may be directly connected to hook 1700 and/or hook 1710, such that rings 1702 and/or 1706 may be eliminated. Other methods of hanging the traveler 100 are illustrated in FIGS. 18 and 19. In FIG. 18, the traveler 100 is attached to a hanger 1600 via a ring 112. FIG. 19 also uses a hanger 1600 to hang traveler 100. As shown in FIG. 19, ring 1702 is placed over the hook of a hanger 1600. In another embodiment, ring 1706 may be eliminated by directly connecting the chain 1704 to the hook 1710.

Figure 23A:
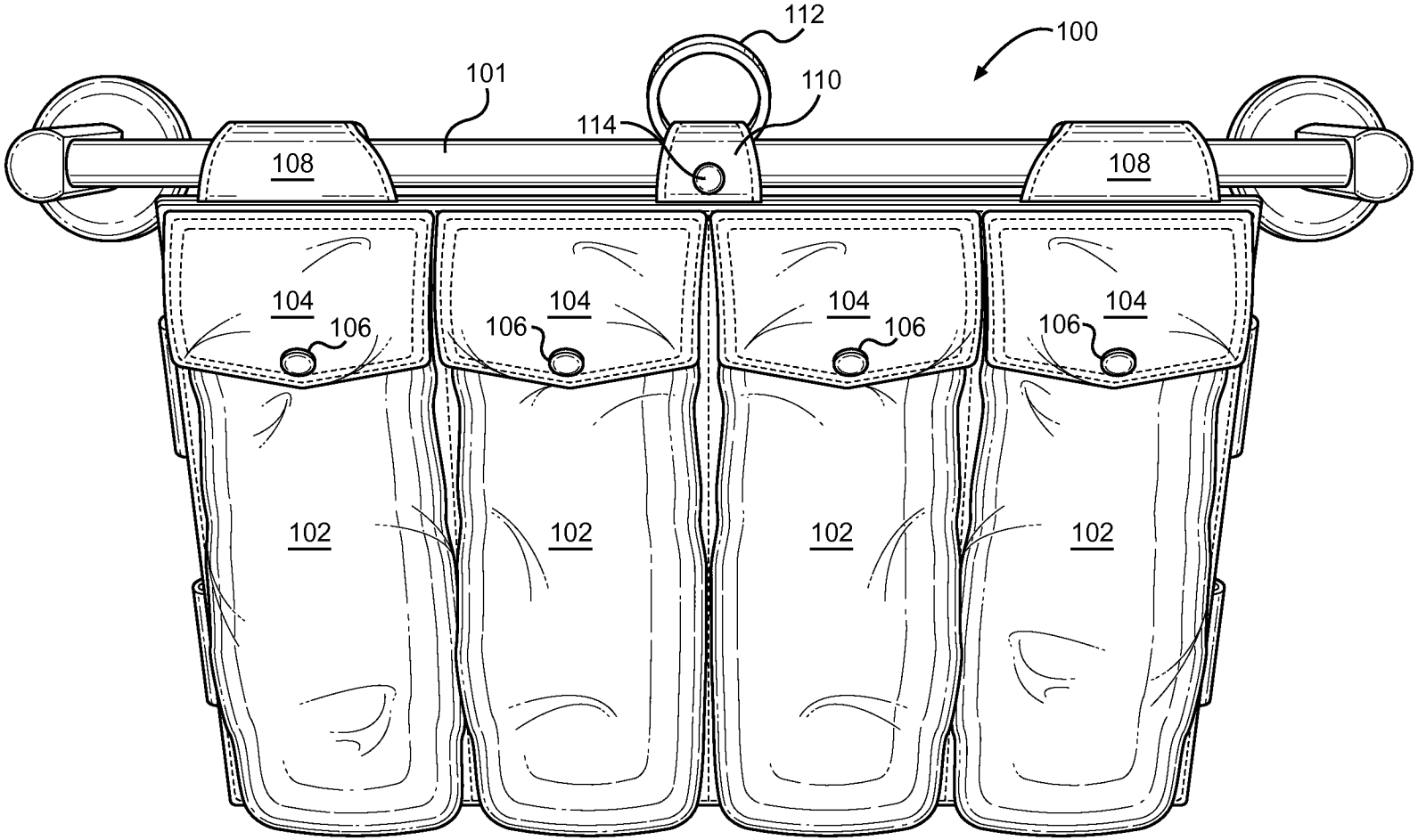
FIGS. 23A and 23B are perspective views of examples of garment holder and hamper traveler coupled to horizontal bars according to embodiments.
Figure 23B:
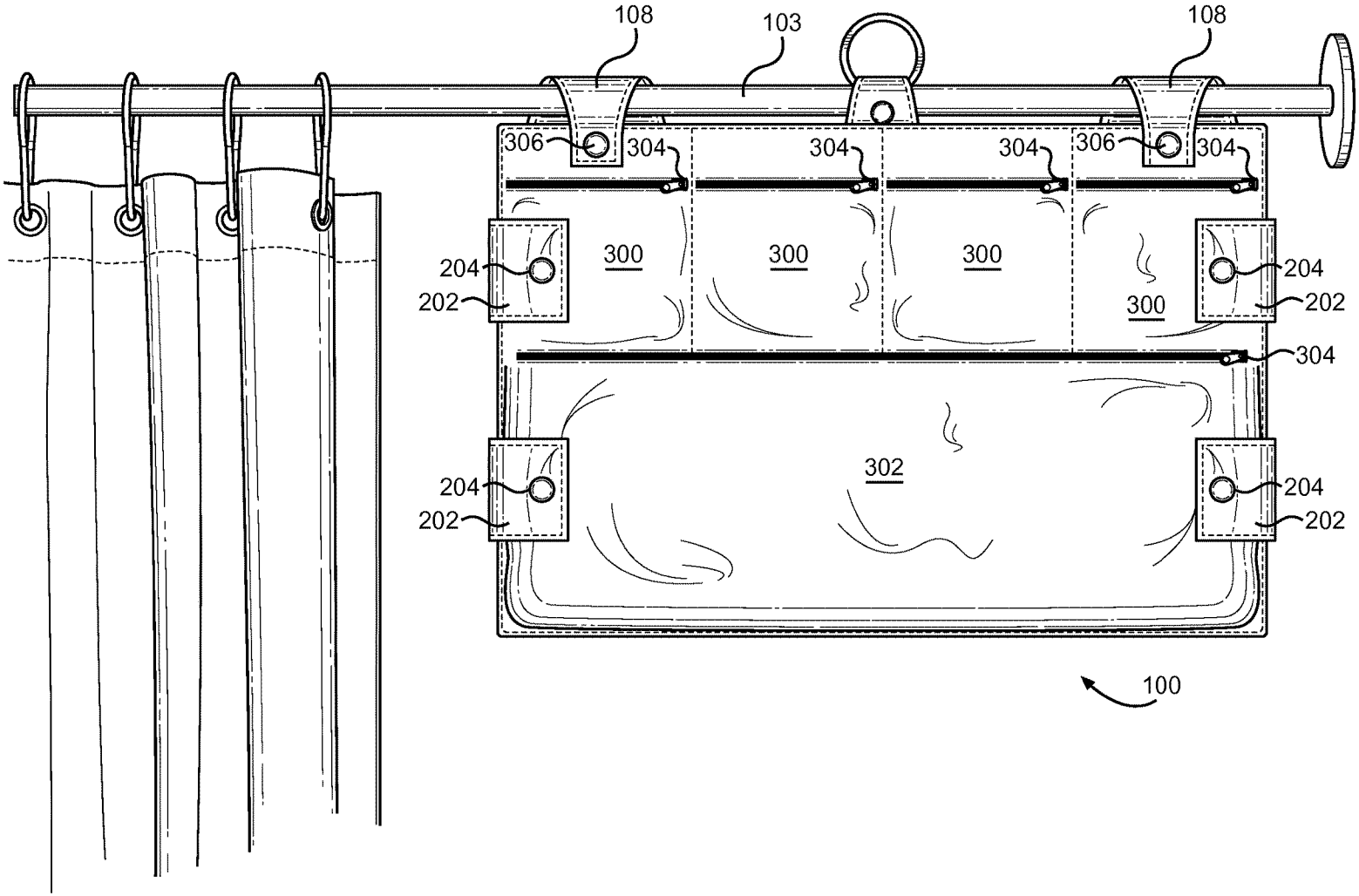

FIG. 23A shows the traveler 100 coupled to a towel bar 101. In the illustrated example, each strap 108 includes a fixed end and a detachable end, wherein the strap 108 is sized to wrap the detachable end around the towel bar 101. Similarly, FIG. 23B shows the traveler 100 coupled to a shower rod 103, wherein the detachable end of the straps 108 wrap around the shower rod 103 and secure the traveler 100 via the snaps 306.

Figure 20:
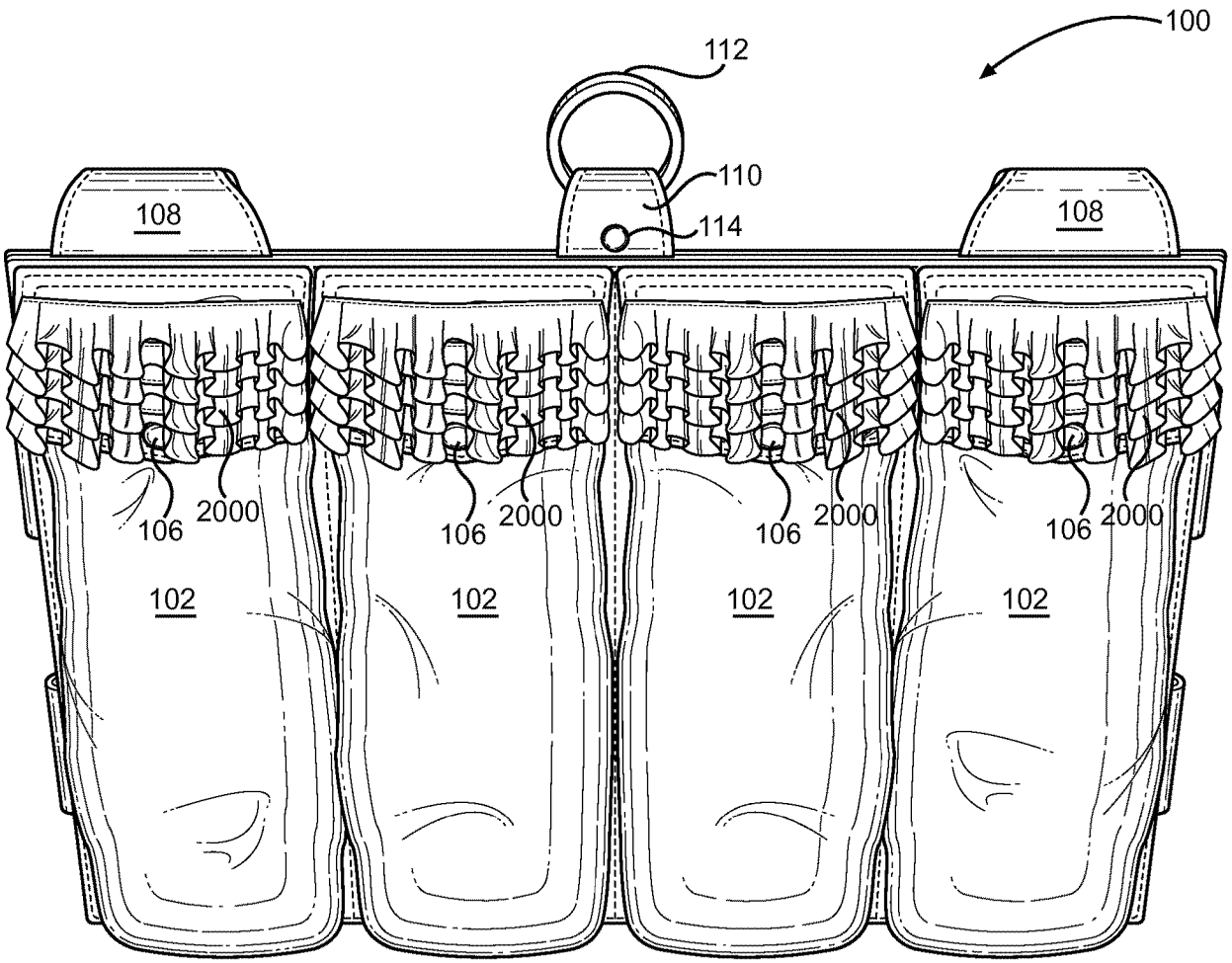
FIG. 20 is a perspective view of the front of an example of a garment holder and hamper traveler in accordance with an alternative embodiment.

FIG. 20 is an alternative embodiment of the frontal design of the traveler 100 in accordance with an embodiment of the present invention. As shown in FIG. 20, decorative ruffles 2000 cover flaps 104 of the front pockets 102 of the traveler 100. In another embodiment, pockets 102 and/or flaps 104 may be decorated with other types of trimmings, such as, for example, embroidery, beading, tassels, pleats, etc.

Figure 21:
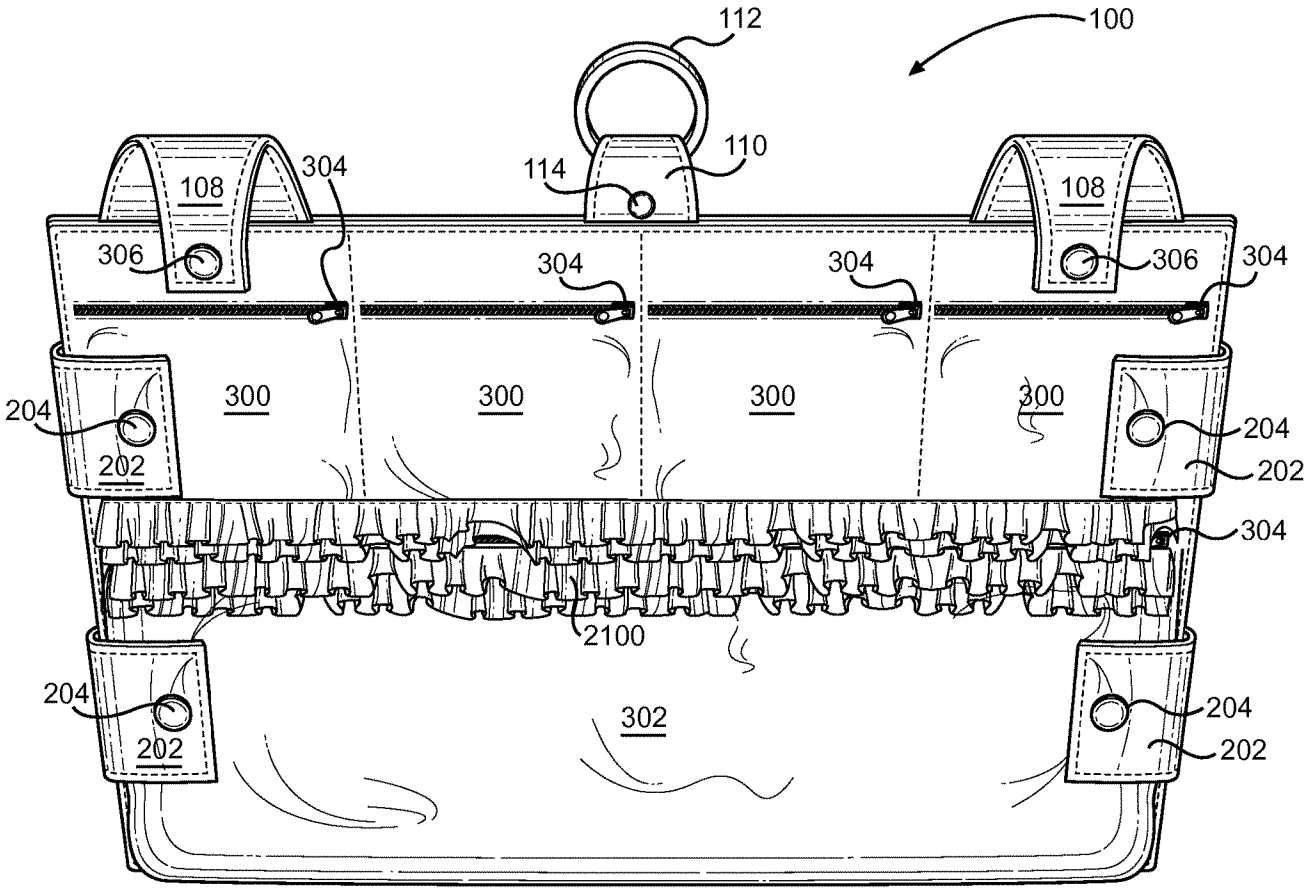
FIG. 21 is a perspective view of the back of an example of a garment holder and hamper traveler in accordance with an alternative embodiment.

FIG. 21 is an alternative embodiment of the rear design of the traveler 100 in accordance with an embodiment of the present invention. As shown in FIG. 21, decorative ruffles 2100 cover the top of pocket 302 of the traveler 100. In another embodiment, pockets 300 and 302 may be decorated with other types of trimmings, such as, for example, embroidery, beading, tassels, pleats, etc.

Figure 22:
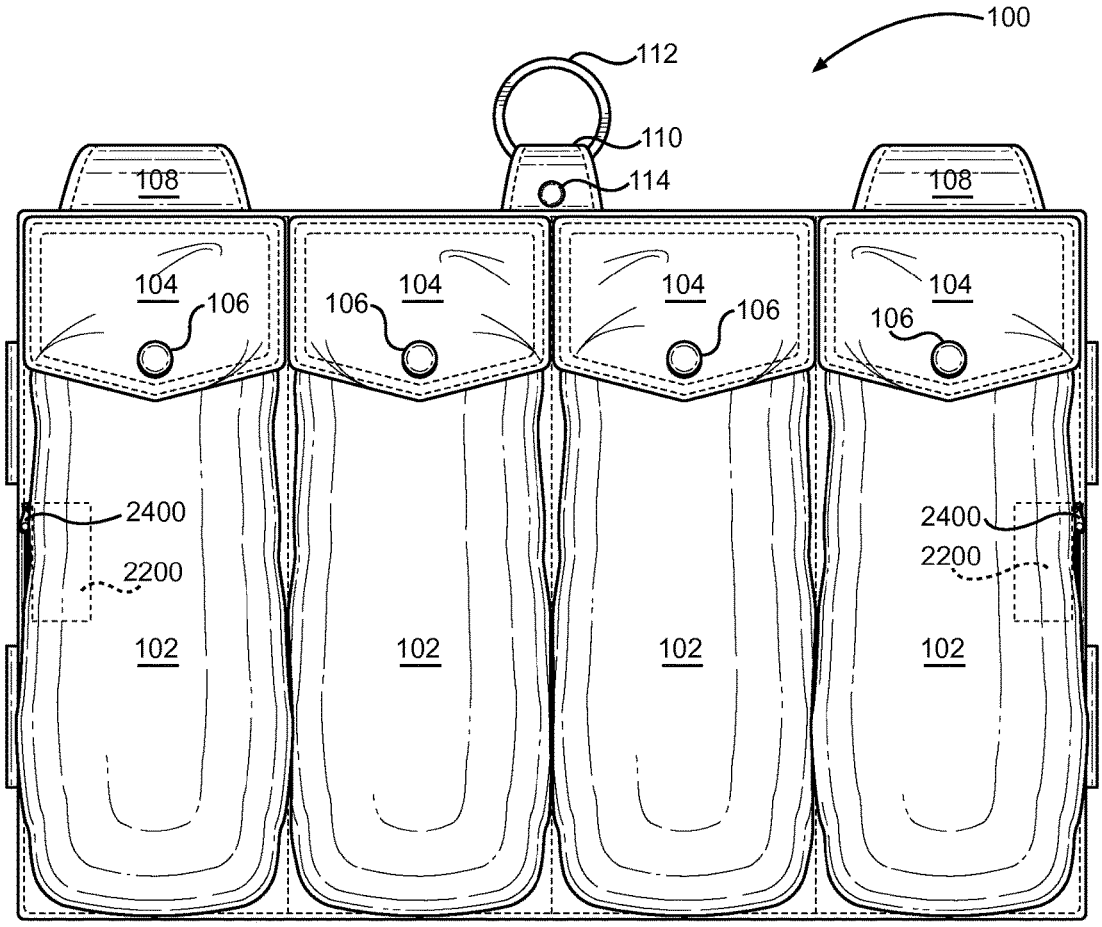
FIG. 22 is a perspective view of the front of an example of a garment holder and hamper traveler in accordance with an alternative embodiment.

FIG. 22 is an alternative embodiment of the traveler 100 in accordance with an embodiment of the present invention. As shown in FIG. 22, an area having a fragrance pouch 2200 is located on each side of the front of the traveler 100. One may insert a fragrant swatch, stick, or any other matter providing a fragrance in each of the pouches 2200 to permeate the traveler 100, the luggage or carrying bag, and the space in which the traveler 100 is hung. In this regard, the fragrance pouches 2200 may be made of a mesh or other material that is permeable to scents. Each pouch 2200 may be securely closed using a zipper 2400. In other embodiments, the size and the location of pouch 2200 on the traveler 100 may vary. The pouches 2200 may also be securely closed with a snap or hook and loop fastener.

Figure 24:
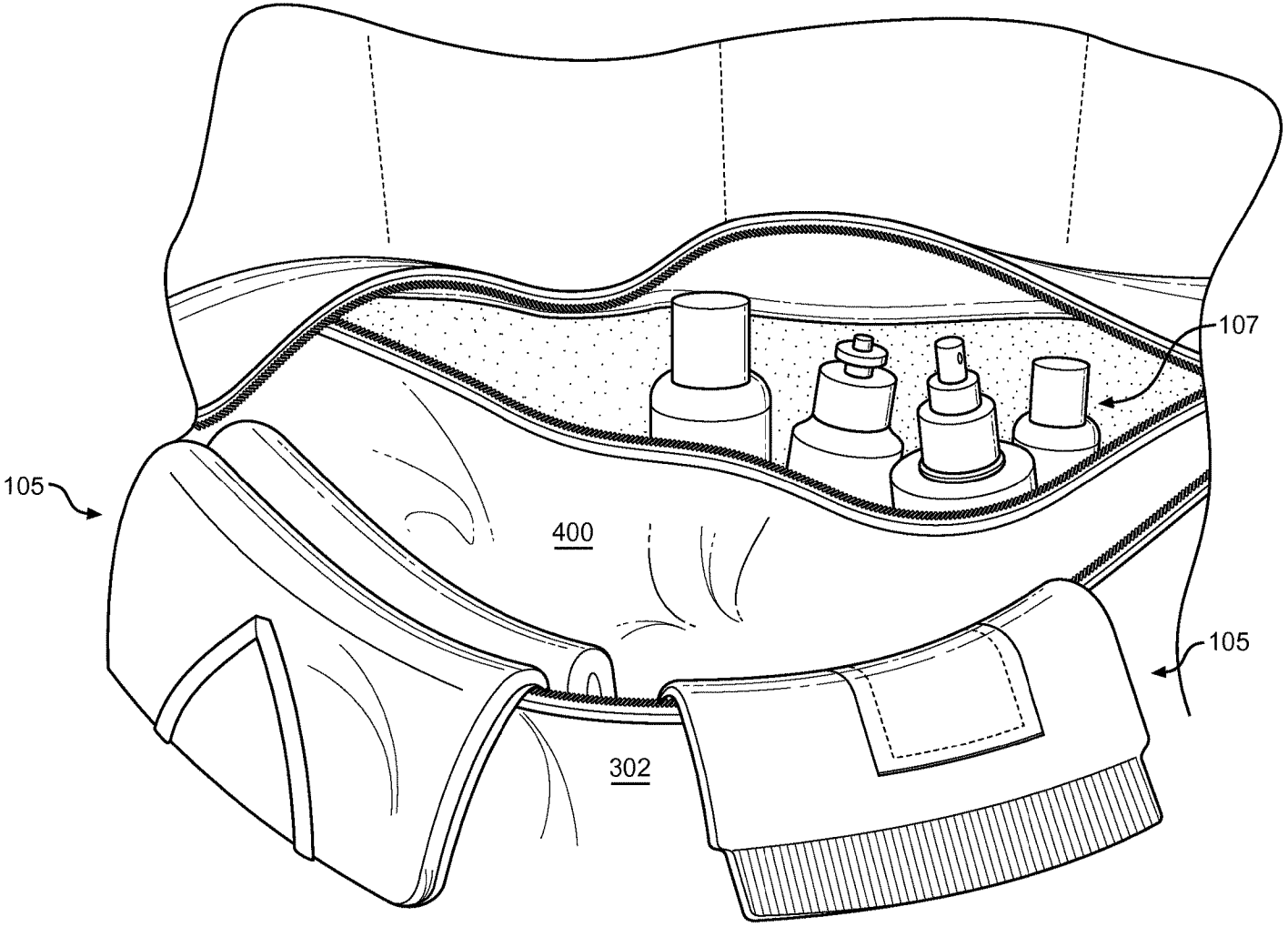
FIG. 24 is a perspective view of the back of a garment holder and hamper traveler that separately carries small garments and toiletries in back two-in-one-pocket according to an embodiment.

FIG. 24 shows an enlarged perspective view of the back of a traveler in which the outer back pocket 302 is used to store garments 105 such as tops and shorts, and the water repellent hamper pocket 400 is used to store toiletries 107.

While various embodiments of the embodiments have been described above, it should be understood that they have been presented by way of example only, and not limitation. It will be understood by those skilled in the art that various changes in form and details may be made therein without departing from the spirit and scope of the embodiments as defined in the appended claims. Thus, the breadth and scope of the embodiments should not be limited by any of the above-described examples, but should be defined in accordance with the following claims and their equivalents.

We claim:

1. A traveler comprising:

a plurality of front two-in-one pockets, each of the front two-in-one pockets including a water repellent hamper pocket predominately inside of a front pocket, wherein the water repellent hamper pocket has a volume that lies mostly within the front pocket, wherein the front pocket includes a flap that provides access to both the front pocket and the water repellent hamper pocket within the front pocket such that when the flap is closed, the water repellent hamper pocket is wholly contained inside the front pocket and is hidden from view, and wherein the water repellent hamper pockets and the front pockets are sized to hold approximately an equivalent amount of items;

a plurality of hanging straps extending from a top portion of the traveler, each hanging strap including a fixed end and a detached end, wherein each hanging strap is sized to wrap the detachable end around a horizontal bar;

a first plurality of side fasteners extending from a left side portion of the traveler;

a second plurality of side fasteners extending from a right side portion of the traveler, each side fastener including a fixed end and a detachable end, wherein the traveler is foldable between an enlarged state and a reduced state, and wherein the traveler is to be maintained in the reduced state if the first plurality of side fasteners are coupled to the second plurality of side fasteners; and a plurality of back two-in-one pockets, each of the back two-in-one pockets including a water repellent hamper pocket inside of a back pocket, wherein at least one of the back two-in-one pockets has a width that is approximately equal to a width of the traveler.

2. The traveler of claim 1, wherein one or more of the back pockets includes a water repellent material.

3. The traveler of claim 1, wherein one or more of the front pockets includes a water repellent material.

4. The traveler of claim 1, wherein one or more of the water repellent hamper pockets includes a waterproof material.

5. The traveler of claim 1, wherein one or more of the front two-in-one pockets includes a permeable fragrance pouch.

6. The traveler of claim 1, further including:

a loop coupled to the top portion of the traveler; and a ring coupled to the loop.

7. A traveler comprising:

a plurality of front two-in-one pockets, each of the front two-in-one pockets including a water repellent hamper pocket predominately inside of a front pocket, wherein the water repellent hamper pocket has a volume that lies mostly within the front pocket, wherein the front pocket includes a flap that provides access to both the front pocket and the water repellent hamper pocket within the front pocket such that when the flap is closed, the hamper pocket is wholly contained inside the front pocket and is hidden from view; and a plurality of hanging straps extending from a top portion of the traveler.

8. The traveler of claim 7, wherein the water repellent hamper pockets and the front pockets are sized to hold approximately an equivalent amount of items.

9. The traveler of claim 7, wherein each hanging strap includes a fixed end and a detachable end.

10. The traveler of claim 9, wherein each hanging strap is sized to wrap the detachable end around a horizontal bar.

11. The traveler of claim 7, further including:

a first plurality of side fasteners extending from a left side portion of the traveler; and a second plurality of side fasteners extending from a right side portion of the traveler, wherein the traveler is foldable between an enlarged state and a reduced state, and wherein the traveler is to be maintained in the reduced state if the first plurality of side fasteners are coupled to the second plurality of side fasteners.

12. The traveler of claim 11, wherein each side fastener includes a fixed end and a detachable end.

13. The traveler of claim 7, further including a back two-in-one pocket, the back two-in-one pocket including a water repellent hamper pocket inside of a back pocket.

14. The traveler of claim 13, wherein the back two-in-one pocket has a width that is approximately equal to a width of the traveler.

15. The traveler of claim 13, wherein the back pocket includes a water repellent material.

16. The traveler of claim 13, wherein the water repellent hamper pocket includes a waterproof material.

17. The traveler of claim 7, wherein one or more of the front pockets includes a water repellent material.

18. The traveler of claim 7, wherein one or more of the water repellent hamper pockets includes a waterproof material.

19. The traveler of claim 7, wherein one or more of the front two-in-one pockets includes a permeable fragrance pouch.

20. The traveler of claim 7, further including:

a loop coupled to the top portion of the traveler; and a ring coupled to the loop.

* * * * *